US009156656B2

(12) United States Patent
Rosenthal

(10) Patent No.: US 9,156,656 B2
(45) Date of Patent: Oct. 13, 2015

(54) FRICTION DRIVE LIFT

(75) Inventor: Dov Rosenthal, Amstelveen (NL)

(73) Assignee: HANDICARE STAIRLIFTS B.V., Heerhugowaard (NL)

( * ) Notice: Subject to any disclaimer, the term of this patent is extended or adjusted under 35 U.S.C. 154(b) by 154 days.

(21) Appl. No.: 13/246,164

(22) Filed: Sep. 27, 2011

(65) Prior Publication Data

US 2012/0073908 A1 Mar. 29, 2012

(30) Foreign Application Priority Data

Sep. 27, 2010 (NL) ..... 2005398

(51) Int. Cl.

*B66B 9/08* (2006.01)
*B61C 11/00* (2006.01)
*E01B 25/22* (2006.01)

(52) U.S. Cl.

CPC ..... *B66B 9/0815* (2013.01); *B66B 9/08* (2013.01); *B66B 9/0846* (2013.01)

(58) Field of Classification Search

CPC ..... B66B 9/08; B66B 9/0807; B66B 9/0846; B61C 13/04; B61C 13/08; B61B 13/04; B61B 13/06; F16C 29/045
USPC ..... 187/200, 201, 202; 105/30, 32; 104/93, 104/107–110, 119, 124
See application file for complete search history.

(56) References Cited

U.S. PATENT DOCUMENTS 891,882 A * 6/1908 Valentine ..... 105/30
2,229,015 A * 1/1941 King ..... 105/30
2,507,887 A * 5/1950 Cheney ..... 187/201
3,164,103 A * 1/1965 Lathers et al. ..... 104/134
3,456,597 A * 7/1969 Jackson ..... 105/30
3,985,081 A * 10/1976 Sullivan, II ..... 104/23.2
3,999,488 A * 12/1976 Monks ..... 105/30
4,382,412 A * 5/1983 Sullivan ..... 104/124
4,648,777 A * 3/1987 Eichenauer ..... 414/591
4,690,064 A * 9/1987 Owen ..... 104/119

(Continued)

FOREIGN PATENT DOCUMENTS

BE 1007308 A6 5/1995
EP 0881188 A1 2/1998
EP 1614650 A2 1/2006

OTHER PUBLICATIONS

Search Report for NL 2005398 dated May 17, 2011.

(Continued)

*Primary Examiner* — William E Dondero
*Assistant Examiner* — Minh Truong
(74) *Attorney, Agent, or Firm* — Hoffmann & Baron, LLP

(57) ABSTRACT

A stair lift for transporting a load includes a longitudinal guide having a first side running surface and a second side running surface opposing the first side running surface; and a carriage which is transportable along the guide and provided with rollers for guiding the carriage along the guide. The rollers include a first roller having a first roller peripheral friction surface which is in frictional engagement with the first side running surface for guiding the carriage along the guide and a second roller having a second roller peripheral friction surface which is in frictional engagement with the second side running surface for guiding the carriage along the guide. The first roller friction surface is provided with a first roller member, and the first side running surface is provided with a longitudinal first side running surface member which fits complementary with the first roller member.

20 Claims, 14 Drawing Sheets

(56) References Cited

U.S. PATENT DOCUMENTS

| | | | | |
|---|---|---|---|---|
| 5,735,214 | A * | 4/1998 | Tsuboi | 105/29.1 |
| 5,934,198 | A * | 8/1999 | Fraser | 105/144 |
| 6,098,550 | A * | 8/2000 | Tsuboi | 105/29.1 |
| 6,564,722 | B1 * | 5/2003 | Kurosawa et al. | 104/155 |
| 6,619,432 | B1 * | 9/2003 | Yasui | 187/250 |
| 6,755,136 | B2 * | 6/2004 | Jenkins | 105/141 |
| 7,225,899 | B2 * | 6/2007 | Molnar et al. | 187/201 |
| 7,341,004 | B2 * | 3/2008 | Sullivan, II | 104/118 |
| 2008/0128213 | A1 * | 6/2008 | Harris | 187/201 |
| 2012/0261216 | A1 * | 10/2012 | Hrenchir et al. | 187/201 |

OTHER PUBLICATIONS

English translation for EP 1614650.
English translation for BE 1007308.

* cited by examiner

FRICTION DRIVE LIFT

CROSS-REFERENCE TO RELATED APPLICATIONS

This application claims the benefit of Netherlands Application No. 2005398, filed Sep. 27, 2010, the contents of which is incorporated by reference herein.

FIELD OF THE INVENTION

The present invention relates to a stair lift for transporting a load.

BACKGROUND OF THE INVENTION

Stair lifts are well known and are particularly used for transporting loads such as persons and/or goods up or down over a stairs by being carried on a chair or a platform. In general a stair lift comprises of a guide or rail to be attached along a staircase and a motorized carriage or trolley which carries and guides the load along the rail.

Stair lifts may be driven by friction drive rollers which are in frictional engagement with the guide. These have proven to be less expensive than form fitted drive means such as sprocket and chains or rack and pinion.

For example, a stair-climbing device is known from patent publication EP-0,881,188-A1. This publication shows a stair-climbing device comprising a guiding rail and a trolley movable on the guiding rail. The stair-climbing device is further provided with a motor that drives a drive roller supported by the trolley, wherein the drive roller is in frictional engagement with the guiding rail. Each longitudinal side of the guiding rail is in frictional engagement with a guiding roller to keep the trolley in a predetermined position with respect to the guided rail. Each drive roller is provided with a means for pressing the drive roller into frictional engagement.

Drawback of these known stair lifts is that they are mechanically complex.

SUMMARY OF THE INVENTION

It is an object of the present invention to eliminate at least one of the abovementioned problems or at least provide an alternative.

In particular, it is an object of the present invention to simplify the state of art stair lifts. The object is achieved by a stair lift according to the invention. This stair lift for transporting a load, comprises a longitudinal guide comprising a first side running surface and a second side running surface opposing the first side running surface. The stair lift furthermore comprises a carriage which is transportable along the guide. The carriage is provided with rollers for guiding the carriage along the guide. The carriage comprises a first roller comprising a first roller peripheral friction surface which is in frictional engagement with the first side running surface for guiding the carriage along the guide. The carriage also comprises a second roller comprising a second roller peripheral friction surface which is in frictional engagement with the second side running surface for guiding the carriage along the guide. Now, the first roller friction surface is provided with a first roller member which peripherally extends in a plane perpendicular to a rotational axis of the first roller. The first side running surface is provided with a longitudinal first side running surface member which fits complementary with the first roller member for supporting the first roller on the first side running surface.

By having the first roller peripheral friction surface of the first roller provided with the first roller member and the first side running surface of the guide provided with the first side running surface member, the first roller is supported by the guide. This has as advantage that the weight of the load is at least partly carried by the guide by means of the first roller. The first roller member offers an extra restriction in movement. In the state of art, the first roller peripheral friction surface only guides the first roller by restricting a movement perpendicular to the first roller peripheral friction surface and the first side running surface. Now, the first roller member results in an extra movement restriction, namely a movement parallel to the first roller peripheral friction surface and parallel to the first side running surface and perpendicular to a roller rolling direction. The roller rolling direction being in the direction of the length of the guide. This may result in a more simple stair lift as other rollers, e.g. rollers comprising a horizontal rotational axis, may carry less weight and/or may be designed more lightly, and/or the number of such rollers with a horizontal rotational axis may be decreased.

The first side running surface of the guide is longitudinal and preferably the length of the first side running surface defines a distance between a start point and an end point for transporting the load. In a further preference, the length of the first side running surface is substantially parallel to a longitudinal axis of the guide.

In a preference, the first side running surface is facing the second side running surface thus being parallel to each other. In another preference, the first side running surface or the second side running surface is in a vertical plane, i.e. a plane comprising the gravitational direction. Alternatively, the first side running surface or the second side running surface are inclined with respect to the vertical plane and defining an angle substantially smaller than 45 degrees, more particularly smaller than 20 degrees and even more particular smaller than 5 degrees.

Preferably, the first roller peripheral friction surface is provided with the first roller member which peripherally extends inwards or outwards in the plane perpendicular to the rotational axis of the first roller. The rotational axis is the axis of rotation and is provided along the centre line of the roller. Peripherally extending meaning extending from the circumference of the first roller defined by the first roller peripheral surface. Extending may be extending inwards or outwards. The first roller member may extend from substantially the whole circumference, i.e. 360 degrees or may in an alternative be interrupted by small gaps. The small gaps are that small that the first roller remains suitable for being supported by the first side running surface member.

In an embodiment, the first roller member is an outwards peripherally extending protrusion, for example a first roller flange. The first roller flange is received by the first side running surface member. In this embodiment, the first side running surface member is a longitudinal recess, for example a first side running surface groove. The longitudinal recess extends inwards away from the first roller. The first roller member is a first roller flange and the first side running surface member is a first side running surface recess which receives the first roller flange. This has as advantage that the guide may be manufactured by easy and cheap extrusion.

In an alternative, the first roller is an inwards peripherally extending recess, for example a first roller groove. The first roller groove receives the first side running surface member. In this alternative embodiment, the first side running surface member is a longitudinal protrusion, for example a first side running surface ridge. The longitudinal protrusion extends outwards towards the first roller. The first roller member is a first roller groove and the first side running surface member is a first side running surface ridge which is received by the first roller groove. This has as advantage that the guide may be manufactured by easy and cheap extrusion.

The shape of the first roller member may be of any shape. For example, the first roller member may be V-shaped or U-shaped. The shape is defined at an outer end when the first roller is the outwards peripherally extending protrusion. The shape is defined at an inner end when the first roller is the inwards peripherally extending recess. In an embodiment the first roller flange has a point shape outer end and the first side running surface recess has a complementary V-shape inner end. This has as advantage that the guide may be manufactured by easy and cheap extrusion.

The shape of the first side running surface member may be of any shape. For example, the first side running surface may be V-shaped or U-shaped. This shape is defined at an outer end when the first side running surface is the longitudinal protrusion. This shape is defined at an inner end when the first side running surface is the longitudinal recess. In an embodiment the first roller groove has a point shape inner end and the first side running surface ridge has a complementary V-shape outer end. This has as advantage that the guide may be manufactured by easy and cheap extrusion.

In an embodiment of the stair lift according to the invention, the guide comprises a topside surface and a downside surface. The topside surface and downside surface are longitudinal sides of the guide and are provided between the first side running surface and the second side running surface. In an embodiment, the topside surface and the downside surface are suitable for frictional engagement with horizontal rollers comprising a horizontal rotational axis.

In an embodiment, the carriage is free from rollers engaging the topside surface and the downside surface. As the first roller member fits complementary with the first side running surface member, the stair lift may be free of rollers in frictional engagement with the topside surface and the downside surface of the guide. More particular, the stair lift is free from horizontal rollers comprising a horizontal rotational axis. In the state of art, rollers engaging the topside surface and downside surface are used to support the carriage, i.e. carry the weight of the carriage. According to this embodiment, the carriage is supported by the first side running surface, by means of the first roller member and the first side running surface member. The second roller provides a counter force at the second side running surface such that the carriage does not move sideways.

This has advantage that less rollers may be needed such that wearing may occur less often and maintenance such as replacing parts with spare parts may be more easy. A further advantage is a reduction of costs and increase ease of manufacturing. Another advantage is that less rollers may result in a reduction of sound. This is particular advantageous for a user of the stair lift.

In an embodiment of the stair lift according to the invention, the carriage is provided with a first drive. The first drive is in a driveable connection with the first roller such that the carriage is driveable by means of friction between the first roller peripheral friction surface and the first side running surface.

This has as advantage that the carriage may be transported more efficiently along the guide in terms of energy. The first roller member and the first side running surface provided more friction between the first roller and the first side running surface. This results in more grip between the first roller peripheral friction surface and the first side running surface. More grip may result in a more efficiently transported carriage in terms of energy.

Preferably, the first drive is a motor, for example an electric motor for driving the first roller rotational axis or spinning axis. As the first roller peripheral friction surface contacts the first side running surface of the guide, the first roller is in a frictional engagement with the guide. By rotating or spinning the first roller, the first roller peripheral friction surface rolls over the first side running surface such that the carriage is transported with respect to the guide.

In an embodiment of the stair lift according to the invention the stair lift further comprises a load carrier. A centre of gravity of the load carrier lies outwards from the second side running surface. The first roller member and the complementary first side running surface member are arranged higher than the second roller and the second side running surface.

This has as advantage that a more rigid guiding and support of the carriage along the guide may be possible. When the load, for example a person, is placed on the load carrier the resulting gravitational force of the load and the load carrier results in a first moment of force with its rotational axis parallel to a length of the guide as the centre of gravity of the load carrier and the load lies outwards from the second side running surface. Outwards meaning away from the guide and the first side roller surface. As the first roller is placed higher than the second roller the moment of forces pushes the first roller into the guide. Particularly, the first roller may press against the first running surface as they are in a frictional engagement. More friction between the peripheral frictional surface of the first roller and the first running surface is generated which may result in a more solid and rigid guiding and support of the carriage along the guide.

In particular the load carrier extends outwards seen from the second side running surface. Outwards being a direction perpendicular to the second side and away from the first side surface and towards the centre of gravity of the load carrier and the load.

Preferably, the first roller is arranged above a line through the centre of gravity of the guide and parallel to the guide, wherein the second roller is arranged below this line.

This has as advantage that the stair lift may be more compact, not taking too much space.

Alternatively, the first roller is arranged above a centre line of the guide and the second roller is arranged below the centre line of the guide.

Preferably, the first roller is arranged near a top of the guide and the second roller is arranged near a bottom of the guide, increasing the distance between the first roller and the second roller and thus increasing a pressing of the first roller in the first running surface and the second roller in the second running surface.

This has as advantage that an even more solid and rigid guiding and supporting of the carriage may be possible.

In a particular advantageous embodiment of the stair lift according to the invention, the carriage is provided with the first drive. The first drive is in a driveable connection with the first roller such that the carriage is driveable by means of friction between the first roller peripheral friction surface and the first side running surface. Furthermore, the stair lift comprises the load carrier. A centre of gravity of the load carrier lies outwards from the second side running surface. The first roller member and the complementary first side running surface member are arranged higher than the second roller and the second side running surface.

This has as advantage that carriage may be transported even more efficiently along the guide in terms of energy. The first roller member and the first side running surface provided more friction between the first roller and the first side running surface. This results in more grip between the first roller peripheral friction surface and the first side running surface. More grip may result in a more efficiently transported carriage in terms of energy. As the first roller is placed higher than the second roller the first moment of force pushes the first roller into the guide. Particularly, the first roller presses against the first running surface as they are in a frictional engagement. Thus more friction between the peripheral frictional surface of the first roller and the first running surface is generated also resulting in more grip.

In an embodiment of the stair lift according to the invention the second roller friction surface is provided with a second roller member which peripherally extends in a plane perpendicular to a rotational axis of the second roller and the second side running surface of the guide is provided with a longitudinal second side running surface member which fits complementary with the second roller member for supporting the second roller along the second side running surface.

By having the second roller peripheral friction surface of the second roller provided with the second roller member and the second side running surface of the guide provided with the second side running surface member, the second roller is supported by the guide. This has as advantage that the weight of the load is at least partly carried by the guide by means of the second roller. The guide also at least partly supports the carriage by means of the first roller. The second roller offers a restriction in movement, namely a movement parallel to the second roller peripheral friction surface and parallel to the second side running surface. This may result in a more simple stair lift as other rollers, e.g. rollers comprising a horizontal rotational axis may carry less weight.

In a further embodiment the carriage is provided with a second drive that is in a driveable connection with the second roller such that the carriage is driveable by means of friction between the second roller and the second running surface.

This has as advantage that the carriage may be transported more efficiently along the guide in terms of energy. The second roller member and the second side running surface provide more friction between the second roller and the second side running surface. This results in more grip between the second roller peripheral friction surface and the second side running surface. More grip may result in a more efficiently transported carriage in terms of energy. Moreover, having two rollers in drivable connection with a drive increases the safety. If one roller fails, the other can still move or at least brake the carriage with respect to the guide.

Preferably, the second drive is a motor, for example an electric motor for driving the second roller rotational axis or spinning axis. As the second roller peripheral friction surface contacts the second side running surface of the guide, the second roller is in a frictional engagement with the guide. By rotating or spinning the second roller, the second roller peripheral friction surface rolls over the second side running surface such that the carriage is transported with respect to the guide.

In an embodiment of the stair lift according to the invention the carriage is provided with a third roller. The third roller comprises a third roller peripheral friction surface which is in frictional engagement with the second side running surface for guiding the carriage along the guide.

Having the third roller allows for a distribution of a second moment of force around an axis parallel to the gravitational direction. This second moment of force is generated as a result of an a-symmetrical load, being a load which acts outside a centre of gravity of the guide, resulting in forces and moments of forces that must safely be distributed over the rollers. In particular, the second moment of force is generated when the guide is inclined with respect to a horizontal plane and a load has its centre of gravity outwards from the second side running surface. Outwards meaning in a direction away from the first side running surface and the second side running surface. Advantageous of the third roller is that it restricts an unwanted rotation of the carriage with respect to the guide around the axis parallel to the gravitational direction.

In a further embodiment the first roller is arranged in a direction along the guide between the second roller and the third roller.

The first roller is in frictional engagement with the first side running surface. The second roller and the third roller are in frictional engagement with the second side running surface, being an opposing side with respect to the first side running surface. Seen along the direction of the guide, being in the longitudinal direction of the guide, the first roller is in engagement with the first side running surface between the second roller and the third roller. This has as result that a distance between the first roller and the second roller is equal to a distance between the first roller and the third roller. This has as advantage that the second moment of force does not result in an unwanted rotation of the carriage with respect to the guide around an axis parallel to the gravitational direction, independent from a direction of rotation of the second moment of force.

In a preference, the third roller is driven by a third drive. Having three rollers in drivable connection with a drive increases the safety. If one or two rollers fail, the other can still move or at least brake the carriage with respect to the guide.

In another further embodiment the carriage is provided with a fourth roller, wherein the fourth roller comprises a fourth roller peripheral friction surface which is in frictional engagement with the first side running surface for guiding the carriage along the guide.

Having the fourth roller results in that two rollers are arranged at the first side running surface and two rollers are arranged at the second side running surface. This has as advantage that the second moment of force does not result in an unwanted rotation of the carriage with respect to the guide around an axis parallel to the gravitational direction, independent from a direction of rotation of the second moment of force.

In a preference, the fourth roller is driven by a fourth drive. In a further preference, the fourth roller comprises a fourth roller member that is in frictional engagement with a complementary second side running surface member.

In another further embodiment the stair lift further comprises a load carrier, wherein a centre of gravity of the load carrier lies outwards from the second side running surface and wherein the first roller is arranged opposite to the third roller or the second roller.

This has as advantage that the second moment of force is distributed to the first roller, second roller and third roller in an optimal manner. This arrangement of the load carrier results in the a-symmetric load. Depending on an inclination of the guide this results in a certain direction of rotation of the second moment of force. The inclination may be such that a first end of the guide is arranged lower than a second end of the guide or vice versa that the second end is arranged lower than the first end. Having the first roller opposite to the second roller or the third roller ensures that a distance between respectively the first roller and the third roller or the first roller and the second roller is maximized. This is advantageous because having this maximized distance ensures that the second moment of force is distributed and spread over the rollers.

This means that forces due to the second moment of force acting on the guide by the rollers is minimized.

All the embodiments, further embodiments, particularly advantageous embodiments and preferences described above and below regarding the first roller, first roller member, complementary first side running surface member, first side running surface and first drive also correspond mutatis mutandis to respectively the second roller, second roller member, complementary second side running surface member, second side running surface and second drive, the third roller, third roller member, complementary third side running surface member, third side running surface and third drive, the fourth roller, fourth roller member, complementary fourth side running surface member, fourth side running surface and fourth drive.

In an embodiment of the stair lift according to the invention the carriage is free from active pressure means. Advantage is that this may result in a more easy manufacturing and maintenance of the stair lift. This may reduce the weight and complexity of the carriage which may result in a more safe and more cheap stair lift.

Active pressure means for increasing the friction between the first roller and the first running surface are replaced by friction increasing features such the first roller member fitting complementary with the first side running surface member. Active pressure means are for example spring actuated counter rollers. In particular, active pressure means may be omitted in an embodiment with the first roller being higher than the second roller. Thanks to this relative position of the rollers, a force moment induced by a load on the stair lift presses both rollers on the guide, so they remain in engagement even if they become reduced in size due to wear.

In an alternative embodiment, the stair lift is provided with a minimum of active pressure means that are redundant or supplementary to the friction increasing features of the invention.

In an embodiment of the stair lift according to the invention, the first roller member comprises an upper member side surface and a lower member side surface. The upper member side surface angle defined between the upper member side surface and an auxiliary plane perpendicular to the rotational axis of the first roller is larger than a lower member side surface angle defined between the lower member side surface and the auxiliary plane.

The upper member side surface and the lower member side surface form the first roller member. The upper member side surface originates and extends from the first roller peripheral surface at an upper member side surface origin. The lower member side surface originates and extends from the first roller peripheral surface at a lower member side surface origin. The upper member side surface origin is higher the lower member side surface origin. The upper member side surface and the lower member side surface make an angle with the auxiliary plane such that they approach each other and form a peripheral outer line being a cutting line. Having the angle between the upper member side surface and the auxiliary plane larger than the angle between the lower member side surface and the auxiliary plane results in that the peripheral outer line lies below a middle of the upper member side surface origin and the lower member side surface origin. Here, below is seen in a direction along the gravitational direction.

This has as advantage that it results in a better support in the gravitational direction as the lower member side surface is less oblique to the gravitational direction compared to the upper member side surface such that the carriage is better supported by the guide. Less oblique in this context means nearer to a perpendicular arrangement with respect to the gravitational direction.

In an embodiment of the stair lift according to the invention, the first roller is provided with a plurality of first roller members and the first side running surface of the guide is provided with a plurality of first side running surface members which supports the plurality of first roller members.

Advantage of this embodiment is that the stair lift may result in a more simple stair lift. The plurality of first roller members corresponding with the plurality of first side running surface members increases support of the first roller by the first side running surface. This has as advantage that each first side running surface member is redundant which may increase safety.

The plurality of first roller members is arranged in parallel planes, each plane being perpendicular to the rotational axis of the first roller. Each first roller member peripherally extends in the plane perpendicular to the first roller rotational axis. The first roller rotational axis is provide along the centre line of the first roller. The corresponding plurality of longitudinal first side running surface members is arranged in the corresponding parallel planes.

In another embodiment of the stair lift according to the invention the guide is an aluminium extruded rail. This has as advantage that the rail may be easier and more cheap to manufacture.

The present invention also relates to a method for transporting a load over a staircase by means of a stair lift according to the invention. The method comprises the step of guiding the carriage along the guide from a start point to an end point.

By having the first roller peripheral friction surface of the first roller provided with the first roller member and the first side running surface of the guide provided with the first side running surface member, the first roller is supported by the guide. This has as advantage that the weight of the load is at least partly carried by the guide by means of the first roller. The first roller offers an extra restriction in movement. In the state of art, the first roller peripheral friction surface only guides the first roller by restricting a movement perpendicular to the first roller peripheral friction surface and the first side running surface. Now, the first roller member results in an extra movement restriction, namely a movement parallel to the first roller peripheral friction surface and parallel to the first side running surface and perpendicular to a roller direction. The roller direction being in the direction of the length of the guide. This may result in a more simple stair lift as other rollers, e.g. rollers comprising a horizontal rotational axis may carry less weight.

These and further embodiments of the stair lift and the method according to the invention are described herein.

BRIEF DESCRIPTION OF THE DRAWINGS

These and other aspects, characteristics and advantages of the present invention will be explained in more detail by means of the following description of two embodiments of the stair lift according to the invention, in which identical reference numerals denote identical components, and in which.

DETAILED DESCRIPTION OF THE INVENTION

Figure 1:
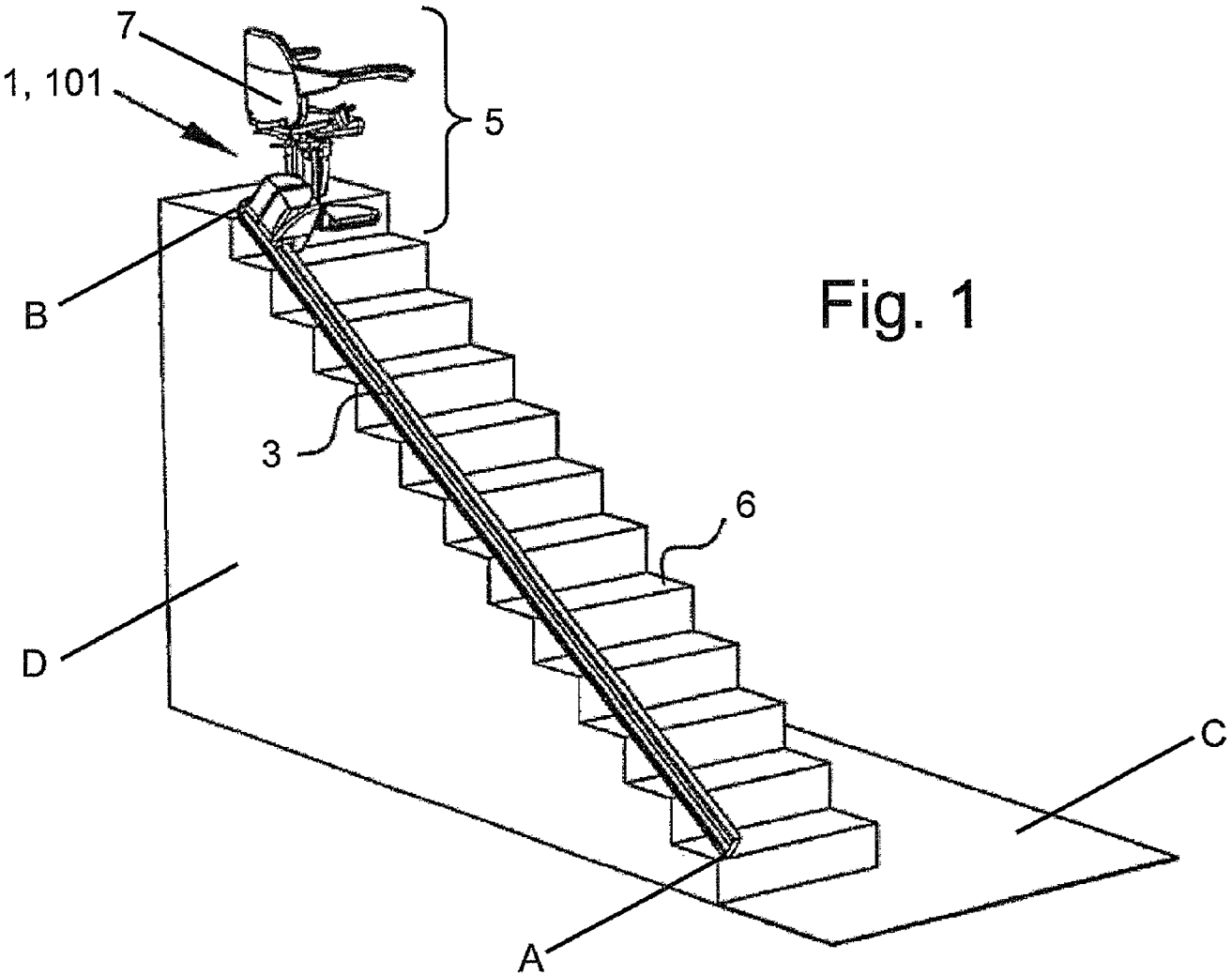
FIG. 1 shows a perspective view of a first embodiment of a stair lift according to the invention and a staircase.

FIG. 1 shows a stair lift 1 according to the first embodiment of the invention and comprises a guide 3 and a carriage 5. The guide 1 is arranged along a staircase 6. The staircase may be used by a person to transport himself from a start point to an end point or vice versa. In FIG. 1 it is shown that the guide 1 is arranged from start point A to start point B. When the person is handicapped or for other reasons unable to use the staircase 6, the person may use the stair lift 1 to be transported from start point A to end point B or vice versa. In this embodiment the stair lift 1 further comprises a load carrier 7 in the form of a seat. The load carrier 7 may be used by the person to sit on. Particularly, when the person is seated in the load carrier 7 the person may be transported between start point A and end point B or vice-versa. Alternatively, the load carrier 7 is a flat platform for carrying a wheel chair or goods. In FIG. 1 the guide 3 is shown as a straight rail.

Figure 2:
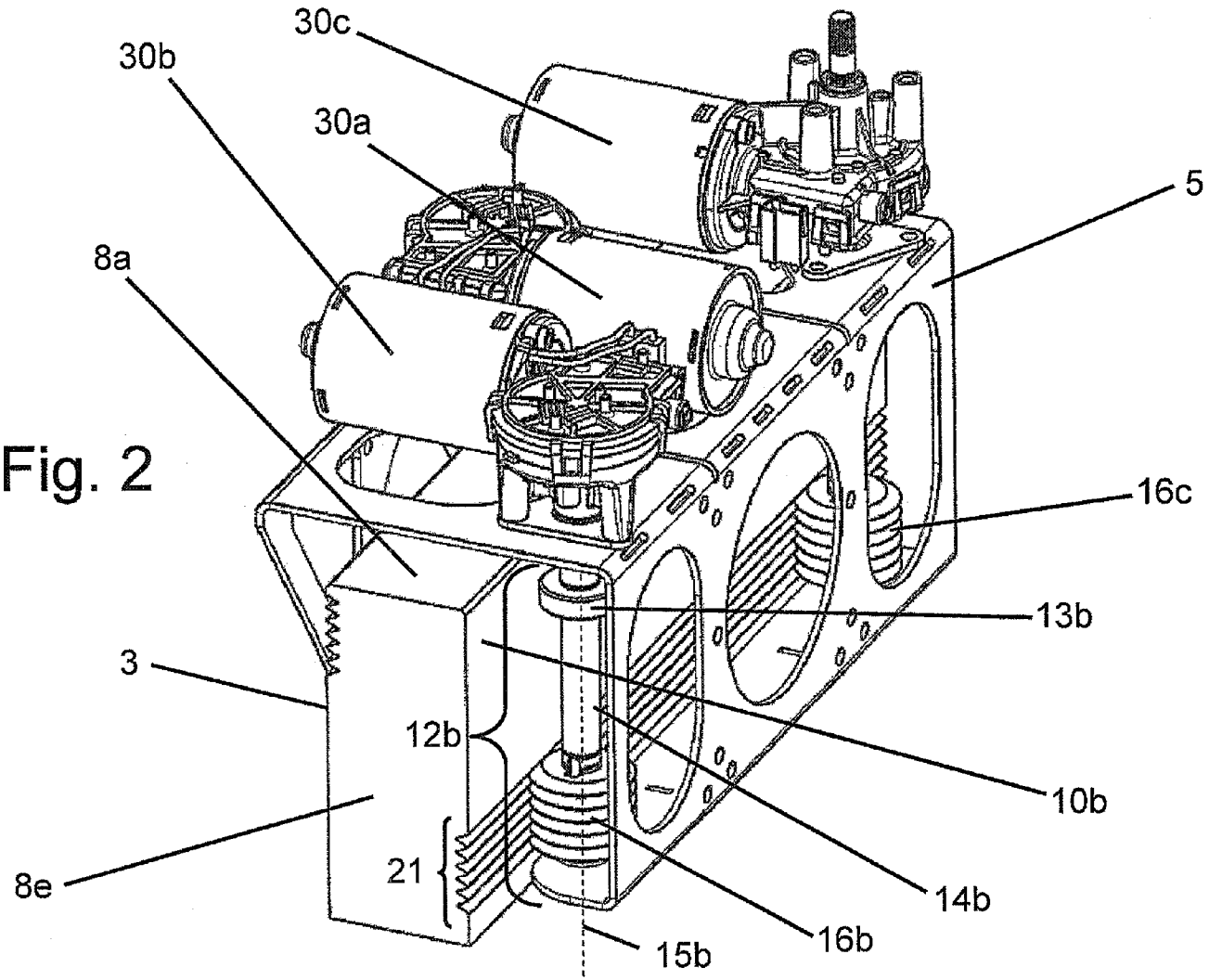
FIG. 2 shows a more detailed perspective view of the first embodiment.

FIG. 2 shows a perspective view of the stair lift 1, showing a part of the guide 3 and part of the carriage 5. The load carrier 7 which forms part of the stair lift 1 is not shown. The shown guide 3 is a longitudinal beam with six sides. Although, the guide 3 is shown as a beam with rectangular sides, the beam may also have different cross sections such as but not limited to a trapezoid beam or an I-beam.

The guide 3 comprises a topside 8*a* and a downside 8*b*. The downside 8*b* can be seen in FIG. 3. The topside 8*a* is opposite and parallel to the downside 8*a*. The topside 8*a* and the downside 8*b* are longitudinal sides. The guide 3 also has a first side surface 8*c* comprising a first side running surface 10*a* and a second side surface 8*d* comprising a second side running surface 10*b*. The first side running surface 10*a* and the second side running surface 10*b* are also longitudinal and are arranged parallel to the vertical plane D preferably comprising the gravitational direction. The topside 8*a* and downside 8*b* are arranged between and perpendicular to the first side running surface 10*a* and the second side running surface 10*b*. The first side running surface 10*a* is facing and parallel to the second side running surface 10*b*. Furthermore, the guide 3 comprises a first end 8*e* and a second end 8*f* arranged at both ends of the guide 3. This completes a six sided beam along which the carriage 5 can be transported.

The carriage 5 is provided with rollers for driving the carriage 5 and is thereby transportable along the guide 3. The rollers are for example wheels having a rotational axis. The carriage 5 according to the first embodiment is provided with a first roller 12*a*, a second roller 12*b*, and a third roller 12*c*. The first roller 12*a* is arranged in contact with the first side running surface 10*a* and the second roller 12*b* and third roller 12*c* are arranged in contact with the second side running surface 10*b*. This way the carriage 5 can be supported by the guide 3 even when an a-symmetrical load acts on the carriage 5 through the rollers 12*a*, 12*b*, 12*c*. An a-symmetrical load is a load which acts outside a centre of gravity of the guide 3, resulting in forces and moments of forces that must safely be distributed over the rollers 12*a*, 12*b*, 12*c*.

Figure 3:
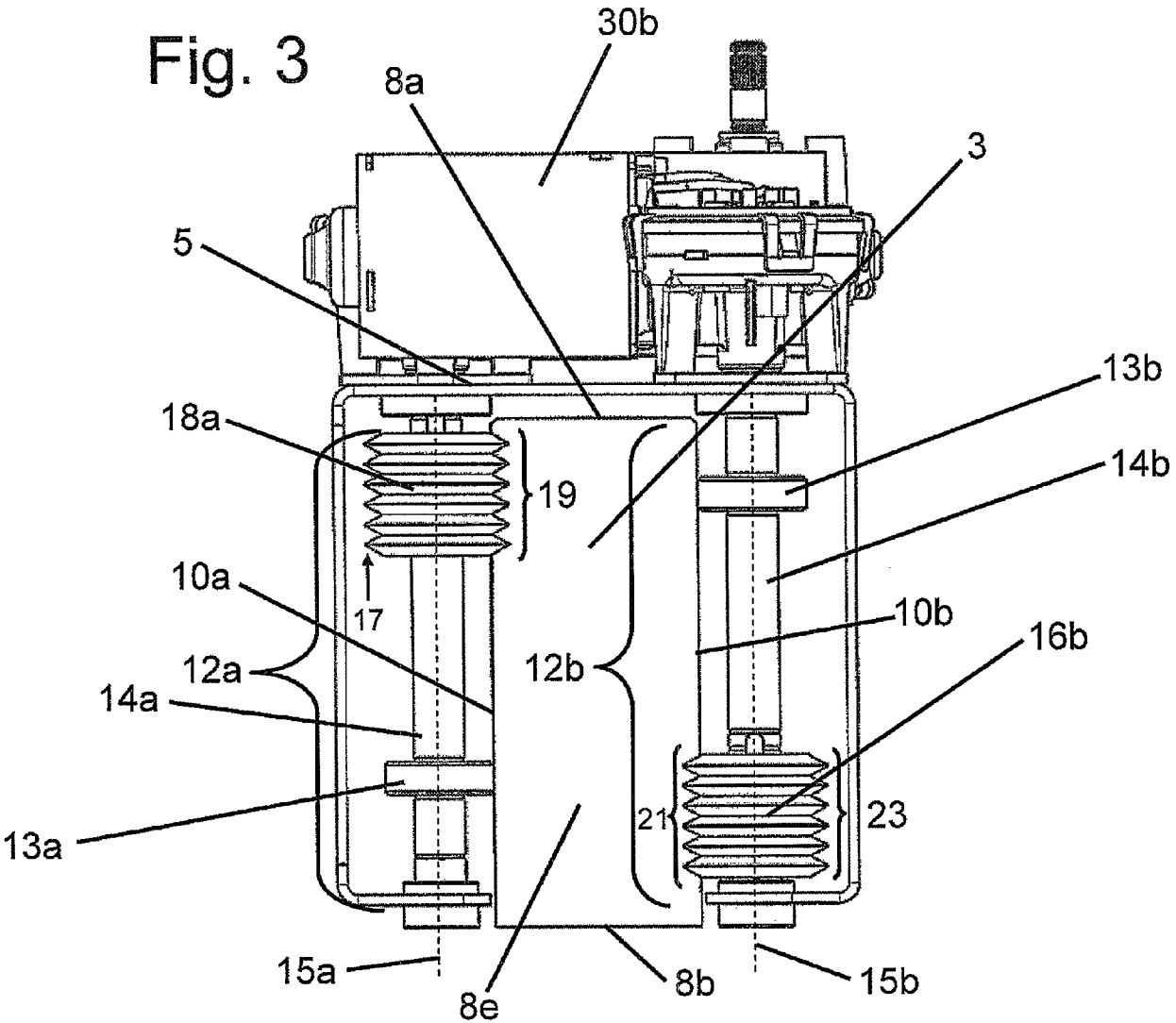
FIG. 3 shows a front view of the first embodiment.

Shown in FIG. 3, the first roller 12*a* comprises a lower auxiliary first roller tyre 13*a*, a first roller upper tyre 18*a* and a first roller spindle 14*a* having a rotational axis 15*a*. The first roller spindle 14*a* rotates around the first roller rotational axis 15*a*. The lower auxiliary first roller tyre 13*a* and the first roller upper tyre 18*a* are arranged on the first roller spindle 14*a*. The lower auxiliary first roller tyre 13*a* and the first roller upper tyre 18*a* therefore rotate around the first roller rotational axis 15*a*. The first roller upper tyre 18*a* is provided with an peripheral friction surface which is in frictional engagement with the first side running surface 10*a*. By driving the first roller spindle 14*a* the first roller 12*a* can be driven by friction. This contributes to a transportation of the carriage with respect to the guide 3.

The lower auxiliary first roller tyre 13*a* is also in contact with the first side running surface 10*a*. The lower auxiliary first roller tyre 13*a* has the same rotational axis 15*a* as the first roller upper tyre 18*a*. The lower auxiliary first roller tyre 13*a* is arranged on the first roller spindle 14*a*. The lower auxiliary first roller tyre 13*a* has a smooth peripheral friction surface.

Figure 4A:
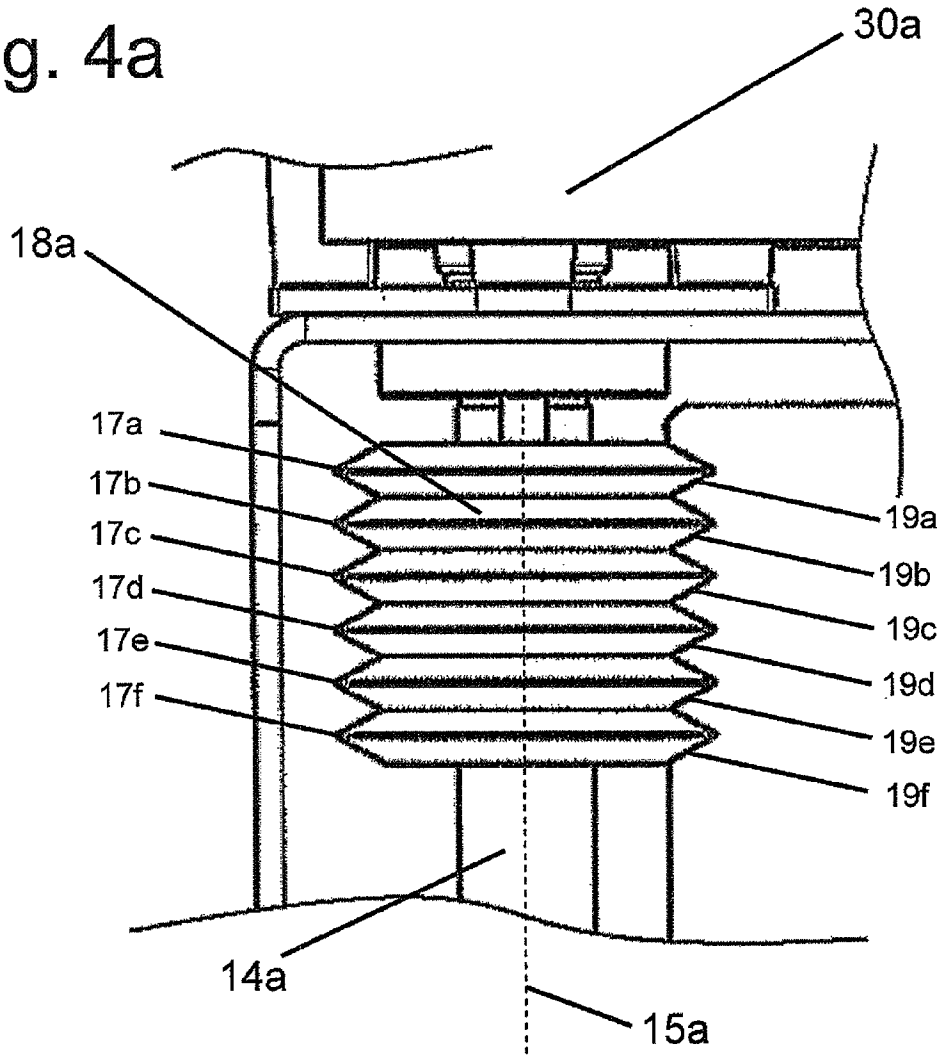
FIG. 4 shows a detail of the front view of the second embodiment.

The first roller upper tyre 18*a* is in frictional engagement with the first side running surface 10*a* of the guide 3. The first roller upper tyre 18*a* is provided with a plurality of upper first roller members 17. The plurality of upper first roller members comprise six separate upper first roller members 17*a*, 17*b*, 17*c*, 17*d*, 17*e*, 17*f*, shown in FIG. 4*a*. The upper first roller members of the plurality of upper first roller members 17 are each arranged in parallel planes each perpendicular to the first roller rotational axis 15*a* and have a point shape in the form of a ^ at their outer end. The plurality of upper first roller members 17 increases its peripheral friction surface.

The first side running surface 10*a* is provided with a plurality of first side running surface members 19. The plurality of first side running surfaces comprises six separate first side running surface members 19*a*, 19*b*, 19*c*, 19*d*, 19*e*, 19*f*, best shown in FIG. 4*a* and have a V-shape at their inner end for receiving the plurality of upper first roller members 17. The first side running surface members of the plurality of first side running surface members 19 are each arranged in parallel planes each perpendicular to the first roller rotational axis 15*a* and are complementary to the plurality of upper first roller members 17. The plurality of upper first roller members 17 fits complementary and is received in the plurality of first side running surface members 19. This has as result that support of the carriage 5 by the guide 3 is increased. The upper first roller peripheral friction surface is larger due to providing the peripheral friction surface with the upper first roller members 17*a*, 17*b*, 17*c*, 17*d*, 17*e*, 17*f*. The first roller upper tyre 18*a* provides an undulated first roller peripheral friction surface which is received in a complementary undulated first side running surface 10*a*. The peripheral friction surface of the plurality of upper first roller members 17 as well as the complementary first side running surface 10*a* are increased. Therefore, more friction between the guide 3 and the carriage 5 can be provided resulting in a more efficient transportation by means of friction.

Shown in FIG. 2 and FIG. 3, the second roller 12*b* is provided to the carriage 5 and comprises a second roller lower tyre 16*b*, an upper auxiliary second roller tyre 13*b* and a second roller spindle 14*b* having a rotational axis 15*b*. The second roller spindle 14*b* rotates around the second roller rotational axis 15*b*. The upper auxiliary second roller tyre 13*b* and the second roller lower tyre 16*b* are arranged on the second roller spindle 14*b*. The upper auxiliary second roller tyre 13*b* and the second roller lower tyre 16*b* therefore rotate around the second roller rotational axis 15*b*. The second roller lower tyre 16*b* is provided with a peripheral friction surface which is in frictional engagement with the second side running surface 10*b* of the guide 3. By driving the second roller spindle 14*b* the second roller 12*b* can be driven by friction. This contributes to a transportation of the carriage 5 with respect to the guide 3.

The upper auxiliary second roller tyre 13*b* is also in contact with the second side running surface 10*b*. The upper auxiliary second roller tyre 13*b* has the same rotational axis 15*b* as the second roller lower tyre 16*b*. The upper auxiliary second roller tyre 13*b* has a smooth peripheral friction surface. The second roller 12*b* is arranged in contact with an opposing side of the first side running surface 10*a*, namely the second side running surface 10*b*. This allows for exerting forces by the first roller 12*a* and second roller 12*b* on the guide 3 in opposing directions.

Figure 4B:
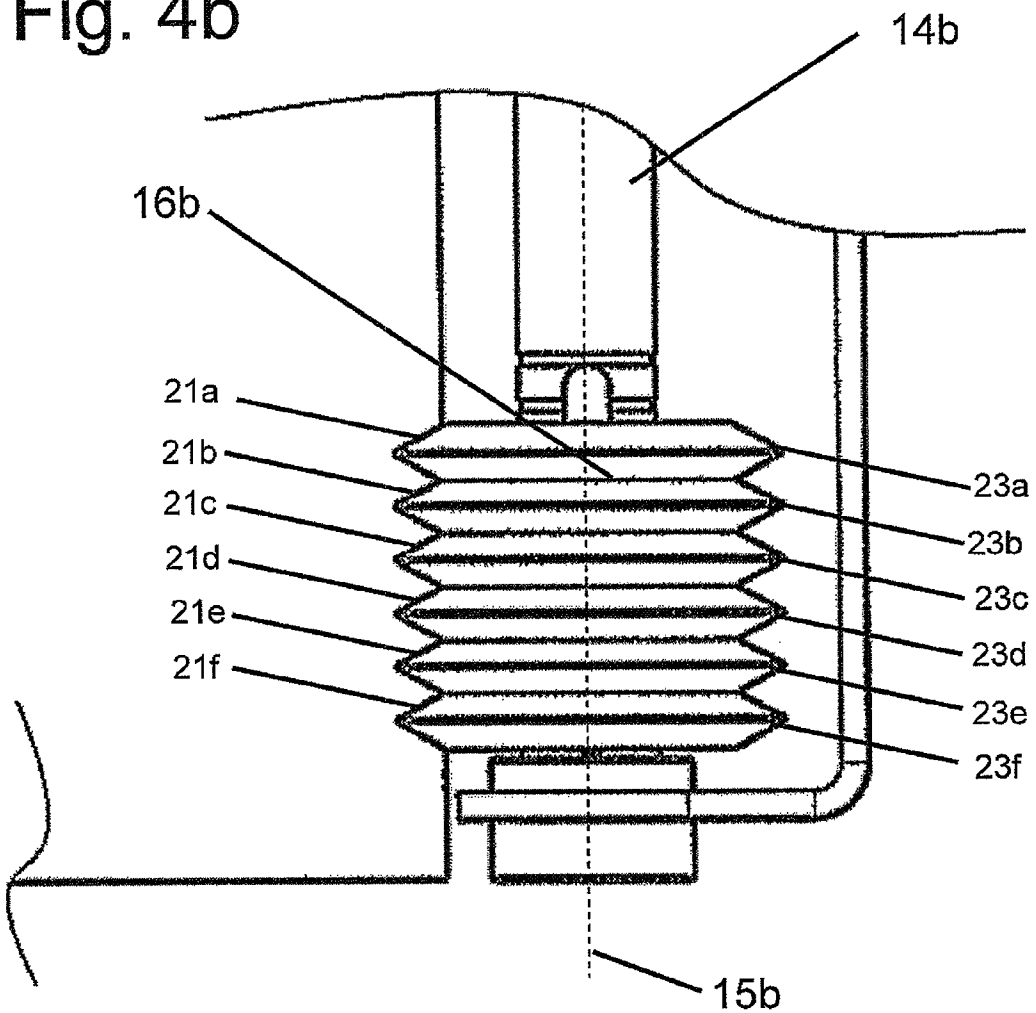

FIG. 2, shows the second side running surface 10*b*. The second side running surface 10*b* comprises a plurality of second side running surface members 21 seen FIG. 4*b*. The second side running surface members 21*a*, 21*b*, 21*c*, 21*d*, 21*e*, 21*f* are arranged longitudinal along the guide 3.

The second roller lower tyre 16*b* is in frictional engagement with the second side running surface 10*b*. The second roller lower tyre 16*b* comprises lower second roller members 23*a*, 23*b*, 23*c*, 23*d*, 23*e*, 23*f* which are arranged in parallel planes each perpendicular to the second roller rotational axis 15*b* and have a point shape in the form of a ^ at their outer end. The second roller lower tyre 16*b* is received in the second side running surface 10*b* due to their complementary fitting supporting members. This allows for further support of the carriage 5 by the guide 3 in a gravitational direction.

Figure 5:
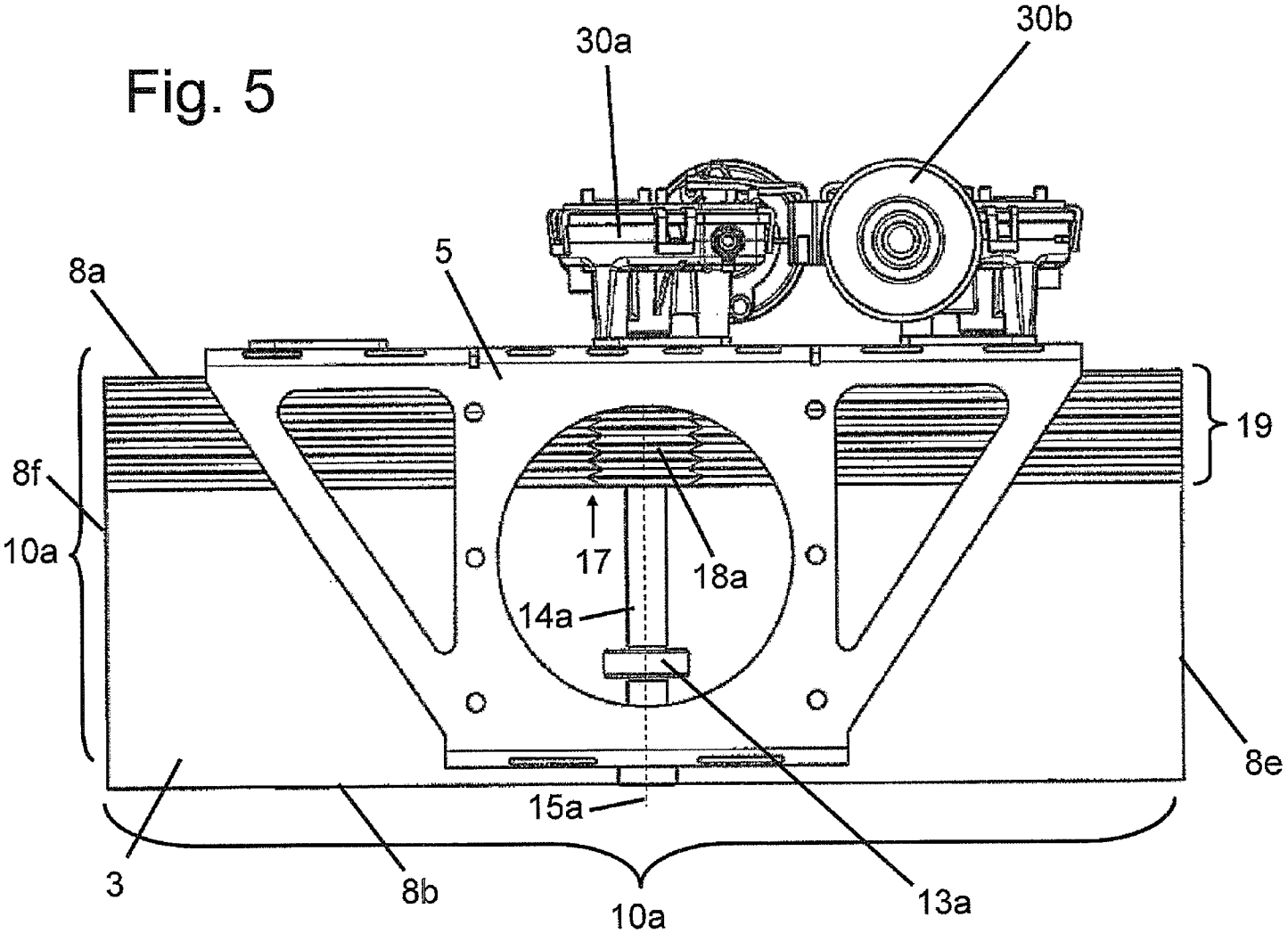
FIG. 5 shows a first side view of the first embodiment.

FIG. 2 and FIG. 5 show a third roller 12*c* comprising a third roller lower tyre 16*c*, an upper auxiliary third roller tyre 13*c* and a third roller spindle 14*c* having a third roller rotational axis 15*c*. The third roller 12*c* is similarly arranged as the second roller 12*b*. The second roller 12*b* is arranged in contact with the second side running surface 10*b*. This results in that the carriage 5 is unable to rotate with respect to the guide 3 when a moment of force is exerted on the carriage 5. An arrangement of three rollers 12*a*, 12*b*, 12*c* arranged in contact with the guide allows for a stable carriage 5.

The third roller lower tyre 16*c* comprises a plurality of lower third roller members 25 comprising six separate lower third roller members 25*a*, 25*b*, 25*c*, 25*d*, 25*e*, 25*f* which are received and supported by the second side running surface members 21*a*, 21*b*, 21*c*, 21*d*, 21*e*, 21*f* of the second side running surface 10*b*. The second roller 12*b* and third roller 12*c* therefore complementary fit with the same second side running surface members 21*a*, 21*b*, 21*c*, 21*d*, 21*e*, 21*f* by means of the second roller lower tyre 16*b* and third roller lower tyre 16*c* respectively. This allows for further support of the carriage 5 by the guide 3 in the gravitational direction.

The second roller 12*b* and third roller 12*c* are in a frictional engagement with the second side running surface 10*b* of the guide 3. Similar to the first roller 12*a* and second roller 12*b*, the upper auxiliary third roller tyre 13*c* and the third roller lower tyre 16*c* are arranged on the third roller spindle 14*c*. The upper auxiliary third roller tyre 13*c* and the third roller lower tyre 16*c* therefore rotate around the third roller rotational axis 15*c*. Driving the third roller 12*c* contributes to transporting the carriage 5 with respect to the guide 3.

FIG. 2 further shows that the carriage 5 comprises a first drive 30*a* for driving the first roller 12*a*, a second drive 30*b* for driving the second roller 12*b* and a third drive 30*c* for driving the third roller 12*c*. The drives 30*a*, 30*b*, 30*c* drive the respective rollers 12*a*, 12*b*, 12*c* such that the carriage 5 can be transported along the guide 3. The drives 30*a*, 30*b*, 30*c* are in a driveable connection with the respective spindles 14*a*, 14*b*, 14*c* of the respective rollers 12*a*, 12*b*, 12*c*.

By driving the respective rollers 12*a*, 12*b*, 12*c*, the first roller upper tyre 18*a*, the second roller lower tyre 16*b* and third roller lower tyre 16*c* are driven and rotating as well. The respective tyres 18*a*, 16*b* and 16*c* are in a frictional engagement with the respective running surfaces 10*a*, 10*b* and drive the carriage by means of friction. As the respective tyres are provided with respective roller members their respective roller peripheral friction surface is increased as the respective roller members are received in the respective fitting complementary side running surface members of the respective running surfaces 10*a*, 10*b*.

Similarly, the lower auxiliary first roller tyre 13*a*, upper auxiliary second roller tyre 13*b* and upper auxiliary third roller tyre 13*c* are driven by the respective drives 30*a*, 30*b*, 30*c*. These auxiliary tyres have a smooth peripheral friction surface and may contribute less compared to the rollers provided with roller members. However, by driving the auxiliary tyres 13*a*, 13*b* 13*c* a more efficient and stable transport of the carriage may be acquired.

FIG. 3 shows the stair lift form a front view showing the first end 8*e*. The first roller upper tyre 18*a* in frictional engagement with the first side running surface 10*a* is arranged higher than the second roller lower tyre 16*b* in frictional engagement with the second side running surface 10*b*. Seen in FIG. 1, the load carrier 7 extends outwards from the second side running surface 10*b* away from the first side running surface 10*a*. This arrangement of the load carrier 7 results in a moment of force. The fact that the first roller upper tyre 18*a* is arranged higher than the second roller lower tyre 16*b* results in that the moment of force pushes the second roller lower tyre 16*b* towards the second side running surface 10*b* and the first roller upper tyre 18*a* towards the first side running surface 10*a*, thus increasing the frictional engagement. This has as advantage that this provides a passive safety arrangement against wearing as the first roller upper tyre 18*a* and the second roller lower tyre 16*b* are pushed into the respective side running surface 10*a*, 10*b* even when their roller members 17, 23 wear. Similarly, better seen in FIG. 2 the moment of force pushes the third roller lower tyre 16*c* towards the second side running surface 10*b*, increasing the frictional engagement.

Figure 6:
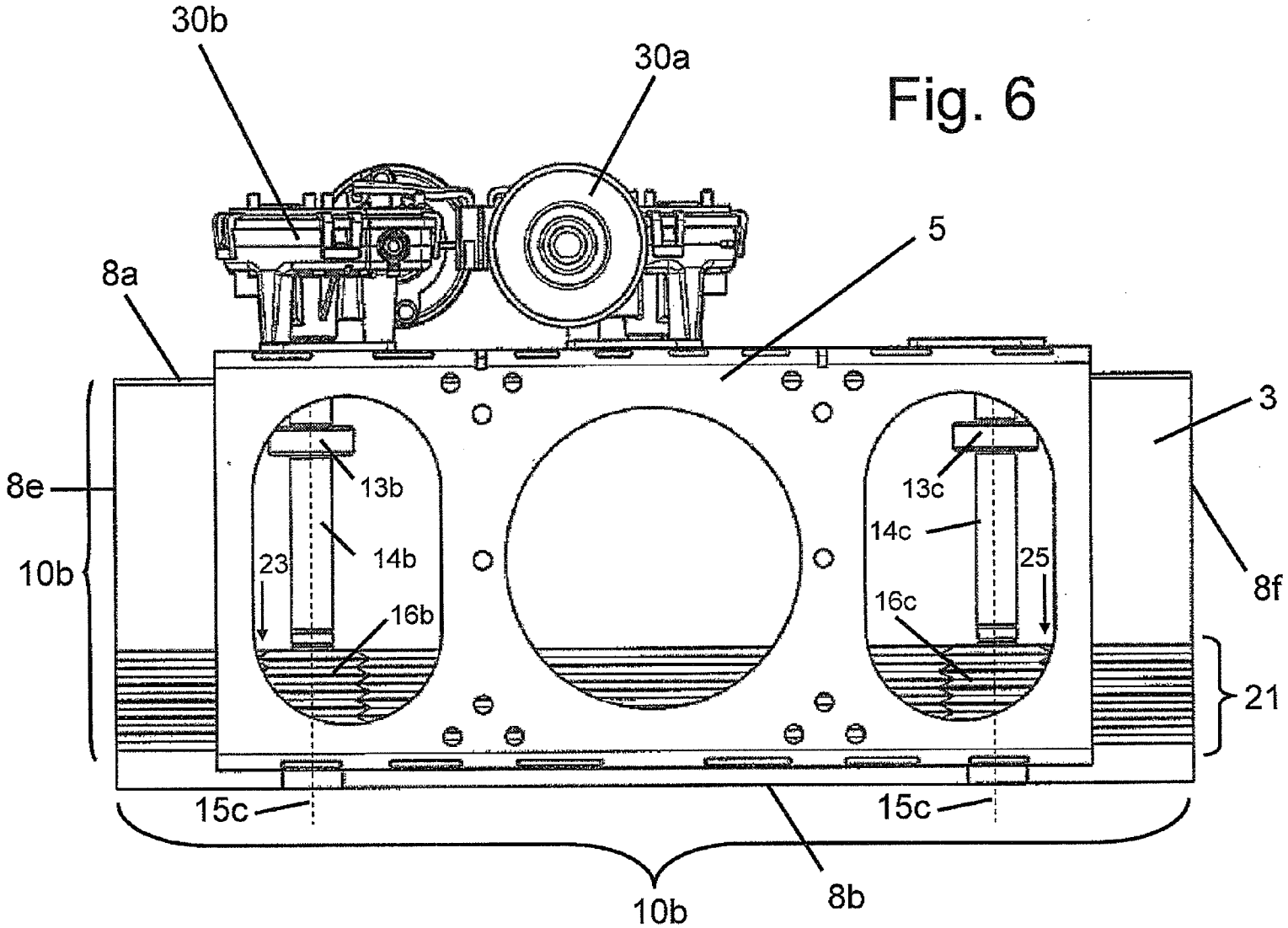
FIG. 6 shows a second side view of the first embodiment.

FIG. 5 and FIG. 6 show respectively the first side running surface 10*a* and the second side running surface 10*b* of the guide 3 and the corresponding carriage 5 and rollers. These figures give an overview of the arrangement of the rollers 12*a*, 12*b*, 12*c* with respect to each other and how the moment of force due resulting from the load carrier 7*a* are distributed over the rollers 12*a*, 12*b*, 12*c*.

In the perspective of FIG. 5, the second end 8*f* is shown at the left of the guide 3. The first end 8*e* is shown at the right of the guide 3. The first side running surface 10*a* is provided with the plurality of first side running surface members 19 above the centre of gravity of the guide 3. In particular, the plurality of first side running surface members 19 is arranged above the middle between the topside 8*a* and the downside 8*b*. The plurality of upper first roller members 17 of the first roller upper tyre 18*a* and the smooth peripheral surface of the lower auxiliary first roller tyre 13*a* are in frictional engagement with the first side running surface 10*a*. The plurality of upper first roller members 17 of the first roller upper tyre 18*a* is received and supported by the plurality of first side running surface members 19 of the first side running surface 10*a*. Having the first roller upper tyre 18*a* arranged above the lower auxiliary first roller tyre 13*a* results in that the first roller upper tyre 18*a* is pressed towards the guide 3. Having the first roller upper tyre 18*a* arranged above the lower auxiliary first roller tyre 13*a* with the centre of gravity of the guide 3 in between results in a relatively compact guide 3 which may be placed along the staircase more conveniently.

In the perspective of FIG. 6, the first end 8*e* is shown at the left of the guide 3. The second end 8*f* is shown at the right of the guide 3. The second side running surface 10*b* is provided with the plurality of second side running surface members 21 below the centre of gravity of the guide 5. In particular, the plurality of second side running surface members 21 is arranged below the middle between the topside 8*a* and the downside 8*b*. The plurality of lower second roller members 23 of the second roller lower tyre 16*b* and the smooth peripheral surface of the upper auxiliary second roller tyre 13*b* are in frictional engagement with the second side running surface 10*b*. Again, due to the moment of force the second roller lower tyre 16*b* is pressed towards the guide 3 resulting in more friction. Having the second roller lower tyre 16*b* arranged below the upper auxiliary second roller tyre 13*b* with the centre of gravity of the guide 3 in between results in a relatively compact guide 3 which may be placed along the staircase more conveniently.

The plurality of lower third roller members 23 and the smooth peripheral surface of the upper auxiliary third roller tyre 13*c* are in frictional engagement with the second side running surface 10*b*. The plurality of lower second roller members 23 and the plurality of lower third roller members 23 are received and supported by the plurality of second side running surface members 21 of the second side running surface 10*b*. Again, due to the moment of force the third roller lower tyre 16*c* is pressed towards the guide 3 resulting in more friction. Having the third roller lower tyre 16*c* arranged below the upper auxiliary third roller tyre 13*c* with the centre of gravity of the guide 3 in between results in a relatively compact guide 3 which may be placed along the staircase more conveniently.

FIG. 1, 7-12 show a stair lift 101 according to a second embodiment. This stair lift 101 comprises components that are similar to the stair lift 1 according to the first embodiment. Similar components are denoted with the same numerals as in FIG. 1 to FIG. 6. The stair lift 101 comprises a guide 3 and a carriage 5 having a load carrier 7 as shown in FIG. 1. The load carrier 7 can be transported over the guide 3 from a start point A to an end point B or vice versa. The carriage 5 further comprises a frame 105. The frame 105 can be seen best in FIG. 8. The frame 105 provides stiffness to the carriage 5 and ensures that a load exerted on the load carrier 7 is safely transferred to the guide 3. The guide 3 defines six sides, being a topside 8*a*, a downside 8*b*, a first side surface 8*c*, a second side surface 8*d*, a first end 8*e* and a second end 8*f*. The sides are longitudinal with the first end 8*e* corresponding to the start point A and the second end 8*f* corresponding to the end point B. The guide 3 is arranged to a staircase 6. The start point A is arranged at a lower point of the staircase 6. The end point B is arranged at an upper point of the staircase 6. Therefore, the guide 3 is inclined with respect to a ground C which is a horizontal plane. This way the load can be transported along the staircase.

Figure 7:
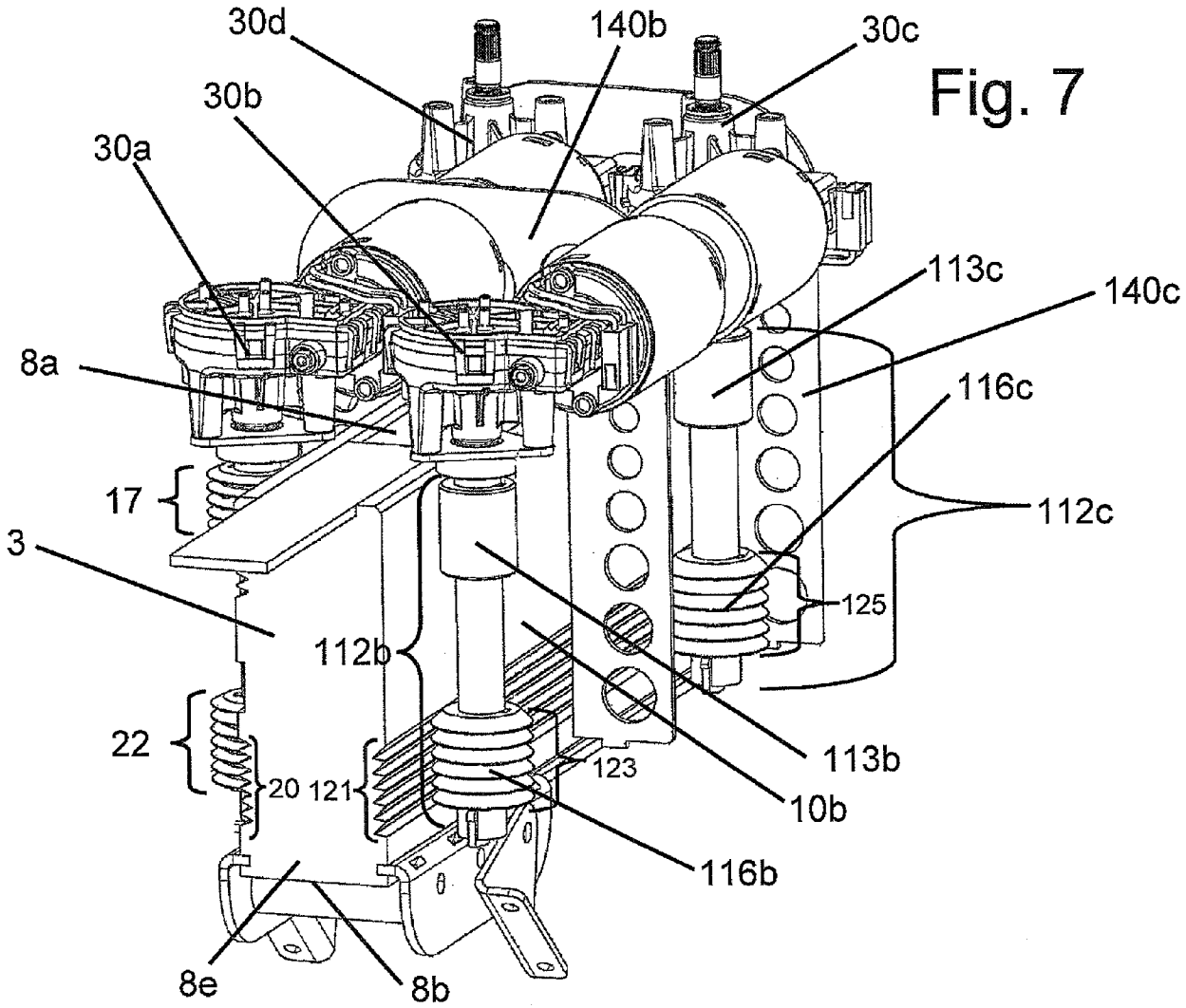
FIG. 7 shows a perspective view of a second embodiment of a stair lift according to the invention.
Figure 8:
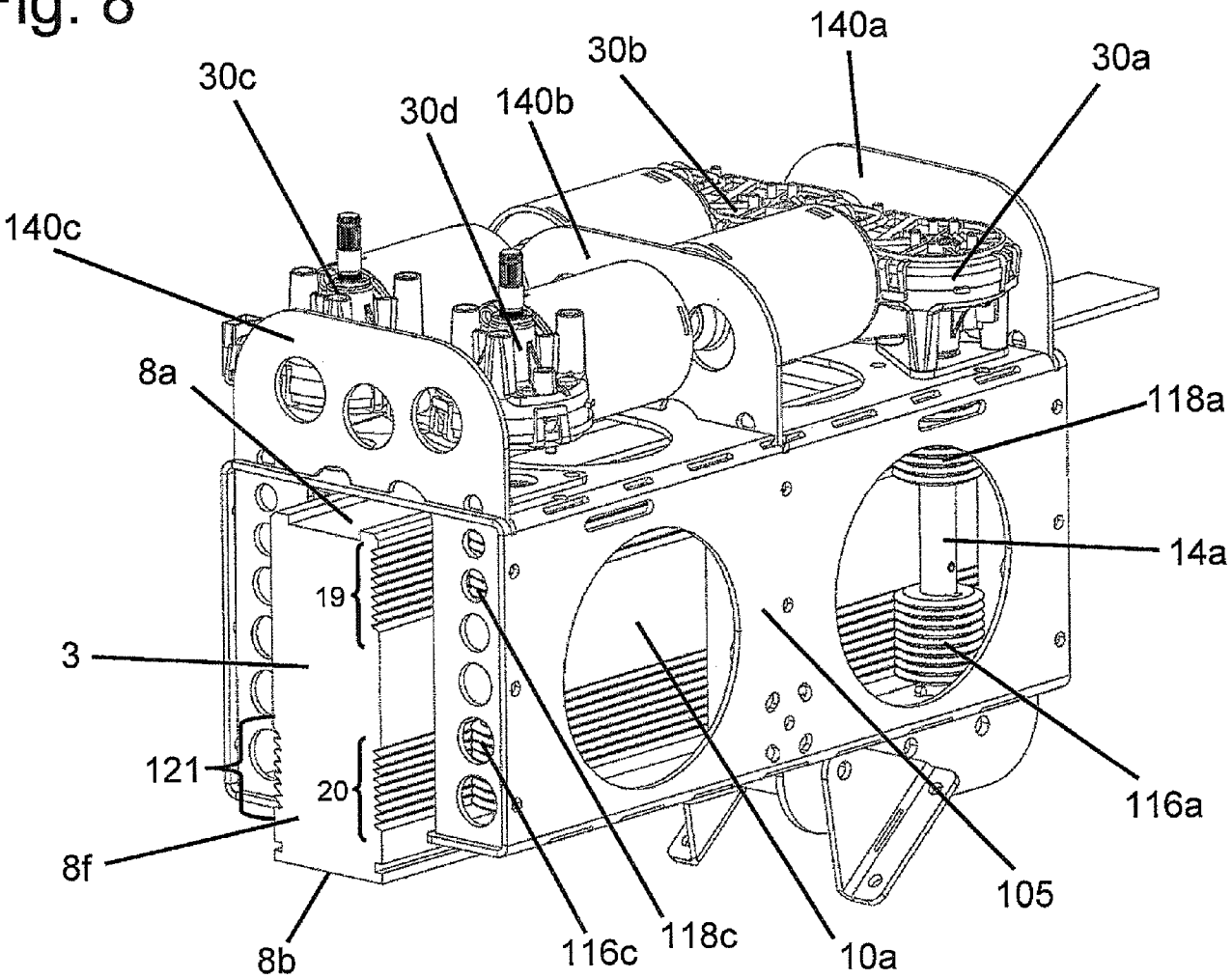
FIG. 8 shows a perspective view from another viewing angle of the second embodiment.
Figure 9:
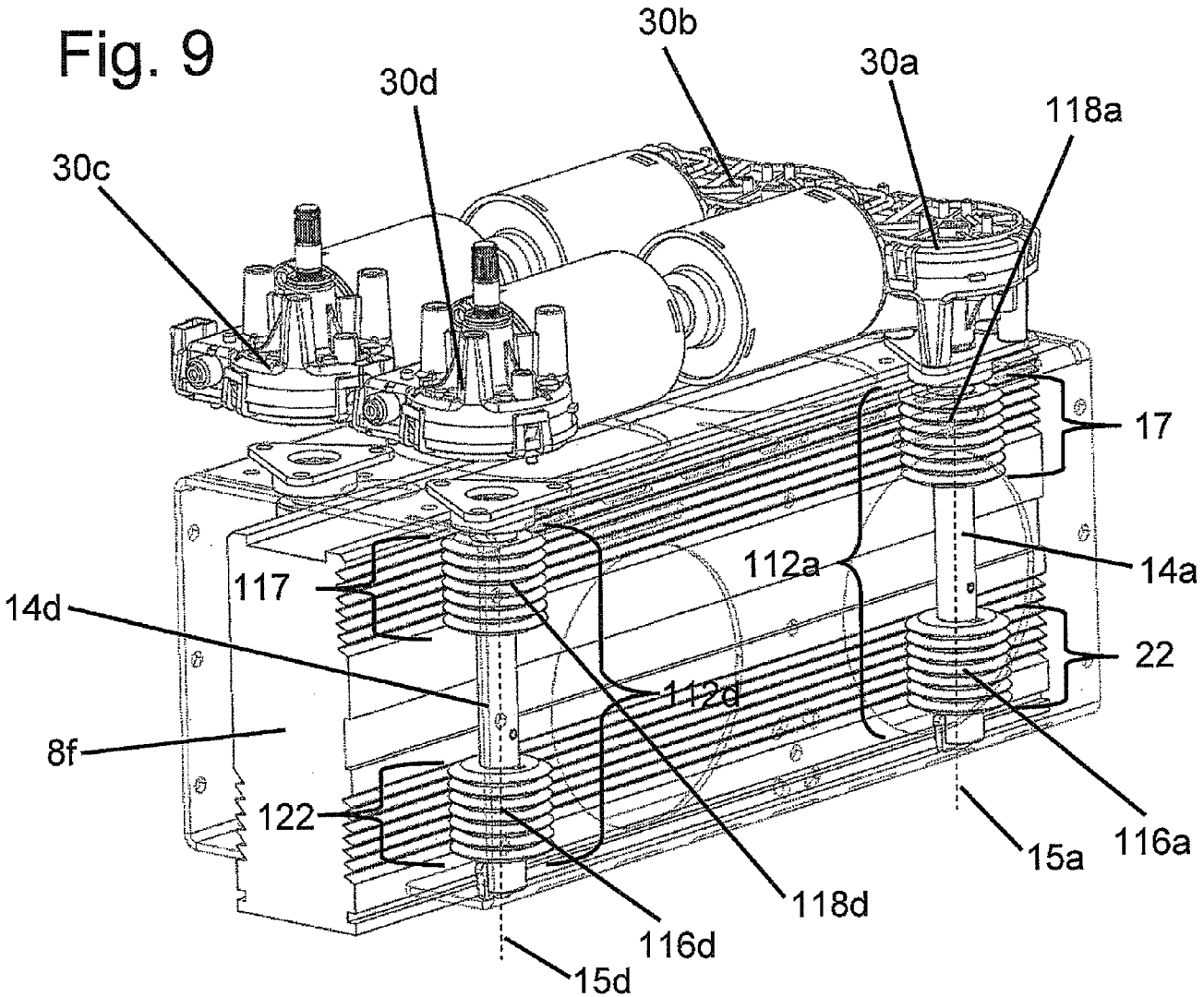
FIG. 9 shows a perspective view similar to FIG. 8 in which components are more conveniently shown.

The first side surface 8*c* comprises a first side running surface 10*a* and the second side surface 8*d* comprises a second side running surface 10*b*. FIG. 7 shows a perspective view showing the first end 8*e* and the second side running surface 10*b*. FIG. 8 and FIG. 9 show a perspective view showing the second end 8*f* and the first side running surface 10*a*. The first side running surface 10*a* and the second side running surface 10*b* are suitable for being in contact with rollers provided to the frame 105. The rollers are for example wheels having a rotational axis.

In this second embodiment the frame 105 is provided with four rollers. Two rollers, being a first roller 112*a* and a fourth roller 112*d*, are arranged in frictional engagement with the first side running surface 10*a*. This can be seen best in FIG. 9. Two other rollers, being a second roller 112*b* and a third roller 112*c* are arranged in frictional engagement with the second side running surface 10*b*. These can be seen best in FIG. 11. Note, that the first side running surface 10*a* and the second side running surface 10*b* are opposing sides. Therefore, the first roller 112*a* and the fourth roller 112*d* are arranged on opposing sides with respect to the second roller 112*b* and the third roller 112*d*. The fact that four rollers are arranged with two rollers on opposing sides has as advantage that forces and moments of forces originated by the load carrier 7 can be distributed safely via the rollers 112*a*, 112*b*, 112*c*, 112*d* to the guide 3 which will be explained below.

The load carrier 7 is substantially parallel to the ground C, as can be seen in FIG. 1. The load carrier 7 extends outwards from the second side running surface 10*b* away from the first side running surface 10*a*. Loading the load carrier 7 combined with the fact that the guide 3 is inclined with respect to the ground C results in an a-symmetrical load. An a-symmetrical load is a load which acts outside a centre of gravity of the guide 3, resulting in forces and moment of forces that must safely be distributed over the rollers 112*a*, 112*b*, 112*c*, 112*d*.

Therefore, the first roller 112*a* and the fourth roller 112*d*, being in contact with the first side running surface 10*a*, are spaced with respect to each other along a longitudinal direction of the guide 3. This can be seen best in FIG. 9. The second roller 112*b* and the third roller 112*c*, being in contact with the second side running surface 10*b* are also spaced with respect to each other along the longitudinal direction of the guide 3. This can be seen best in FIG. 7. This ensures that a second moment of force around an axis parallel to a gravitational direction is distributed towards the second roller 112*b* and fourth roller 112*d*, pressing these rollers 112*b*, 112*d* towards the guide 3 increasing frictional engagement. This second moment of force is generated as a result of the a-symmetrical load. The gravitational direction lies perpendicular to the ground C. Having four rollers 112*a*, 112*b*, 112*c*, 112*d*, in particular two spaced rollers at opposing side running surfaces 10*a*, 10*b*, has as advantage that a distance between a roller at the first side running surface 10*a* and a roller at the second side running surface 10*b* can be larger compared with three rollers such as in the first embodiment. A larger distance between a roller at the first side running surface 10*a* and a roller at the second side running surface 10*b* results in a smaller force distributed by the second moment of force. By increasing the distance the second moment of force results in less pressing of respective rollers towards the guide 3. A more balanced distribution of forces may be acquired. Moreover, the carriage 5 can still be compact.

Furthermore the rollers 112*a*, 112*b*, 112*c*, 112*d* are each arranged with an upper tyre 118*a*, 113*b*, 113*c*, 118*d* and a lower tyre 116*a*, 116*b*, 116*c*, 116*d* that are in contact with the side running surfaces 10*a*, 10*b*. Each roller 112*a*, 112*b*, 112*c*, 112*d* further comprises a roller spindle 14*a*, 14*b*, 14*c*, 14*d* having a rotational axis 15*a*, 15*b*, 15*c*, 15*d*. The upper tyre 118*a*, 113*b*, 113*c*, 118*d* is spaced with respect to the lower tyre 116*a*, 116*b*, 116*c*, 116*d* along the respective rotational axis. The lower tyres 116*a*, 116*b*, 116*c*, 116*d* are arranged near a lower end of the respective roller spindles 14*a*, 14*b*, 14*c*, 14*d*. The upper tyres 118*a*, 113*b*, 118*c*, 113*d* are arranged near an upper end of the respective roller spindles 14*a*, 14*b*, 14*c*, 14*d*. This allows for a distribution of a first moment of force around an axis parallel to the longitudinal direction of the guide 3. This first moment of force, generated as a result of the a-symmetrical load, is distributed towards the first roller upper tyre 118*a*, the fourth roller upper tyre 118*d*, the second roller lower tyre 116*b* and the third roller lower tyre 116*c*.

The frame 105 is further arranged with four motors which drive the rollers 112*a*, 112*b*, 112*c*, 112*d* by rotating their roller spindles 14*a*, 14*b*, 14*c*, 14*d*. The first roller 112*a* is driven by a first motor 30*a*. The second roller 112*b* is driven by a second motor 30*b*. The third roller 112*c* is driven by a third motor 30*c* and the fourth roller 112*d* is driven by a fourth motor 30*d*. By driving the rollers 112*a*, 112*b*, 112*c*, 112*d* the carriage 5 can be transported along the guide 3 by means of friction between the rollers 112*a*, 112*b*, 112*c*, 112*d* and the side running surfaces 10*a*, 10*b*. By driving each roller 112*a*, 112*b*, 122*c*, 112*d* with a separate motor 30*a*, 30*b*, 30*c*, 30*d* sufficient power may be generated to transport the carriage 5 along the guide 3.

The first roller lower tyre 116*a*, first roller upper tyre 118*a*, fourth roller lower tyre 116*d* and fourth roller upper tyre 118*d* comprise each a plurality of roller members 22, 17, 122, 117. Complementary, the first side running surface 10*a* comprises a plurality of upper first side running surface members 19 and a plurality of lower first side running surface members 20. The first roller lower tyre 116*a* and the fourth roller lower tyre 116*d* are arranged such that their respective pluralities of roller members 22, 122 are received by and aligned with the lower first side running surface members 20. The first roller upper tyre 118*a* and the fourth roller upper tyre 118*d* are arranged such that their respective pluralities of roller members 17, 117 are received by and aligned with the upper first side running surface members 19. The plurality of first side running surface members 19, 20 fit complementary with the pluralities of roller members 22, 17, 122, 117 which has as result that support in a gravitational direction of the carriage 5 and frame 105 by the guide 3 is increased.

At an opposing surface, being the second side running surface 10*b*, a plurality of second side running surface members 121 is provided. The second roller lower tyre 116*b* and third roller lower tyre 116*c* comprise each complementary plurality of roller members 123, 125. This means that the second roller lower tyre 116*b* and third roller lower tyre 116*c* are arranged such that they are received by and aligned with the plurality of second side running surface members 121. The plurality of second side running surface members 121 therefore fit complementary with the plurality of roller members 123 of the second roller lower tyre 116*b* and the plurality of roller members 125 of the third roller lower tyre 116*c* which has as result that support in a gravitational direction of the carriage 5 and frame 105 by the guide 3 is increased. This allows the carriage 5 to rest on the guide 3 in combination with the first roller tyres 116*a*, 118*a* and the fourth roller tyres 116*d*, 118*d*.

The second roller upper tyre 113*b* and the third roller upper tyre 113*c* are auxiliary tyres and have a smooth peripheral friction surface. Although they are in frictional engagement with the guide 3 their contribution to drive the carriage 5 may be less than the other tyres which are provided with the pluralities of roller members. The auxiliary second roller upper tyre 113*b* and auxiliary third roller upper tyre 113*c* are cylindrical. Their peripheral outer surface can be increased by increasing a length of the cylinder in a direction parallel to their respective roller axes 15*b*, 15*c*.

The pluralities of roller members 22, 17, 122, 117 of the first roller lower tyre 116*a*, first roller upper tyre 118*a*, fourth roller lower tyre 116*d* and fourth roller upper tyre 118*d* are shaped similar to the ones in the first embodiment. These pluralities of roller members 22, 17, 122, 117 are arranged in parallel planes each perpendicular to the respective rotational axis 15*a*, 15*d* of the roller 112*a*, 112*d* and have a point shape in the form of a ˆ at their outer end.

The pluralities of roller members 123, 125 of the second roller lower tyre 116*b* and the third roller lower tyre 116*c* also have a point shape in the form of a ˆ at their outer end. However, the pluralities of roller members 123, 125 of the second roller lower tyre 116*b* and third roller lower tyre 116*c* are shaped differently inwards from their outer end. This is advantageous as each roller tyre is distributed with a different load due to the a-symmetrical loading of the stair lift 1. By shaping the roller members differently each roller member can exert and optimal force on the guide 3.

Figure 12:
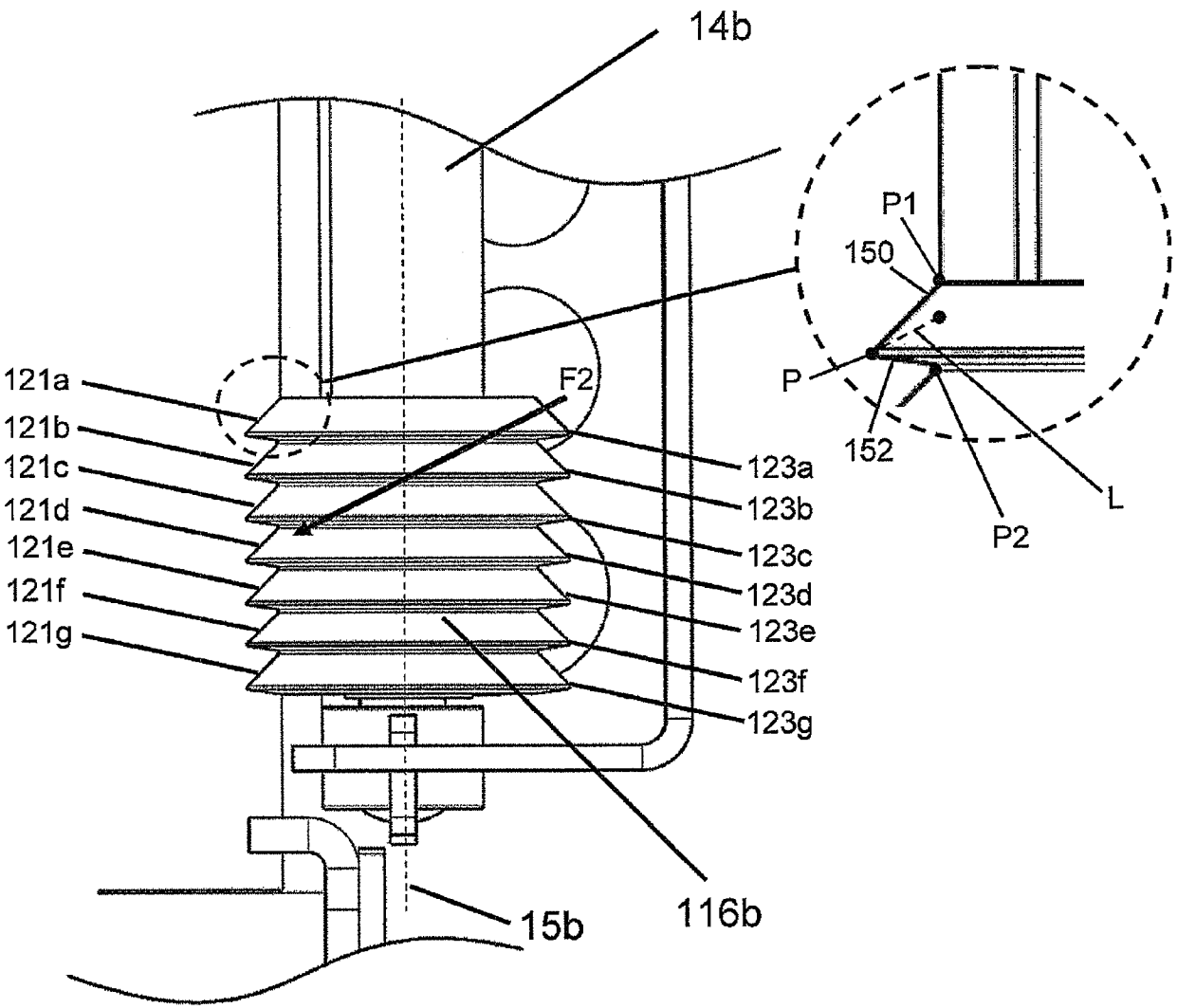
FIG. 12 shows a more detailed front view.

This is explained for the plurality of roller member 123 of the second roller lower tyre 116*b* as shown in FIG. 12. FIG. 12 shows each member of the second side running surface members 121*a*, 121*b*, 121*c*, 121*d*, 121*e*, 121*f*, 121*g*. Here, the plurality of second side running surface members 21 comprise seven individual members. Also shown, is the second roller lower tyre 116*b* comprising the plurality of second roller members 123. The plurality of second roller members 123 is complementary and in frictional engagement with the plurality of second side running surface members 121. Each member of the second roller members 123*a*, 123*b*, 123*c*, 123*d*, 123*e*, 123*f*, 123*g* is shown. Now, the shape of a member of the second roller members 123*a*, 123*b*, 123*c*, 123*d*, 123*e*, 123*f*, 123*f* shall be described in more detail.

This will be done by describing an upper second roller member 123*a*. As can be seen in FIG. 12, the upper second roller member 123*a* is highlighted and shown in more detail at a location where it is in frictional engagement with an upper second side running surface member 121*a*. Note that, the description of the shape particularly also applies for the shape of the roller members of the second roller lower tyre 116*b* and third roller lower tyre 116*c*.

The upper second roller member 123*a* is a flange having a peripheral outer line. The peripheral outer line is circular and is partly in frictional engagement with the upper second side running surface member 121*a* at a point P. In other words, the point P is a location where the peripheral outer line of the upper second roller member 123*a* is in frictional engagement with the upper second side running surface member 121*a*. The upper second roller member 123*a* extends from a peripheral surface to the point P located away from the second roller rotational axis 15*b*. An upper member side surface 150 and a lower member side surface 152 originate from the peripheral surface of the second roller lower tyre 116*b* and extend away from the second roller rotational axis 15*b* where they form the peripheral outer line including point P. The upper member side surface 150 originates from the peripheral surface at an upper member side surface origin P1 and the lower member side surface 152 originates from the peripheral surface at a lower member side surface origin P2 as can be seen in a cross section according to FIG. 12. This cross section is in a plane comprising the second roller rotational axis 15*b* and the point P. A location of the point P is such that a virtual line L between the point P and the middle of the upper member side surface origin P1 and the lower member side surface origin P2 is substantially aligned with a direction of a second roller lower tyre force F2. The second roller lower tyre force F2 is the force that the second roller 112*b* exerts on the second side running surface 10*b* of the guide 3. This has as advantage that the upper member side surface 150 and the lower member side surface 152 generate an optimal friction with the complementary upper second side running surface member 121*a* as the virtual line L runs substantially through their middle generating a same amount of friction to the member side surfaces 150, 152.

The direction of the second roller lower tyre force F2 as shown in FIG. 12 results from the a-symmetrical load. In particular, the second roller lower tyre force F2 is a combination of the first moment of force around an axis parallel to the longitudinal direction of the guide 3 and the gravitational force. In the view of FIG. 12A a direction of the gravitational force is downwards. The first moment of force results in a force pressing the second roller lower tyre 116*b* towards the guide 3. Therefore, in the view of FIG. 12 the direction of the second roller lower tyre force F2 is downwards and to the left. 12. The corresponding virtual line L is aligned along this direction of the second roller lower tyre force F2.

This results in that an upper member side surface angle between the upper member side surface 150 and an auxiliary plane perpendicular to the second roller rotational axis 15*b* is larger than a lower member side surface angle between the lower member side surface 152 and the auxiliary plane.

This has as further advantage that it results in a better support in the gravitational direction as the lower member side surface 152 is less oblique to the gravitational direction compared to the upper member side surface 150 such that the carriage 5 is better supported by the guide 3. Less oblique in this context means nearer to a perpendicular arrangement.

In this particular second embodiment, this results in that the lower member side surface 152 lies in a plane substantially perpendicular to the second roller rotational axis 15*b* as can be seen in FIG. 12.

A shape of the other roller members may be determined in a similar way. In this second embodiment the roller members of the first roller lower tyre 116*a*, first roller upper tyre 118*a*, fourth roller lower tyre 116*d* and fourth roller upper tyre 118*d*, which are located at the opposite first side running surface 10*a*, are pressed substantially horizontal towards the guide 3.

Figure 10:
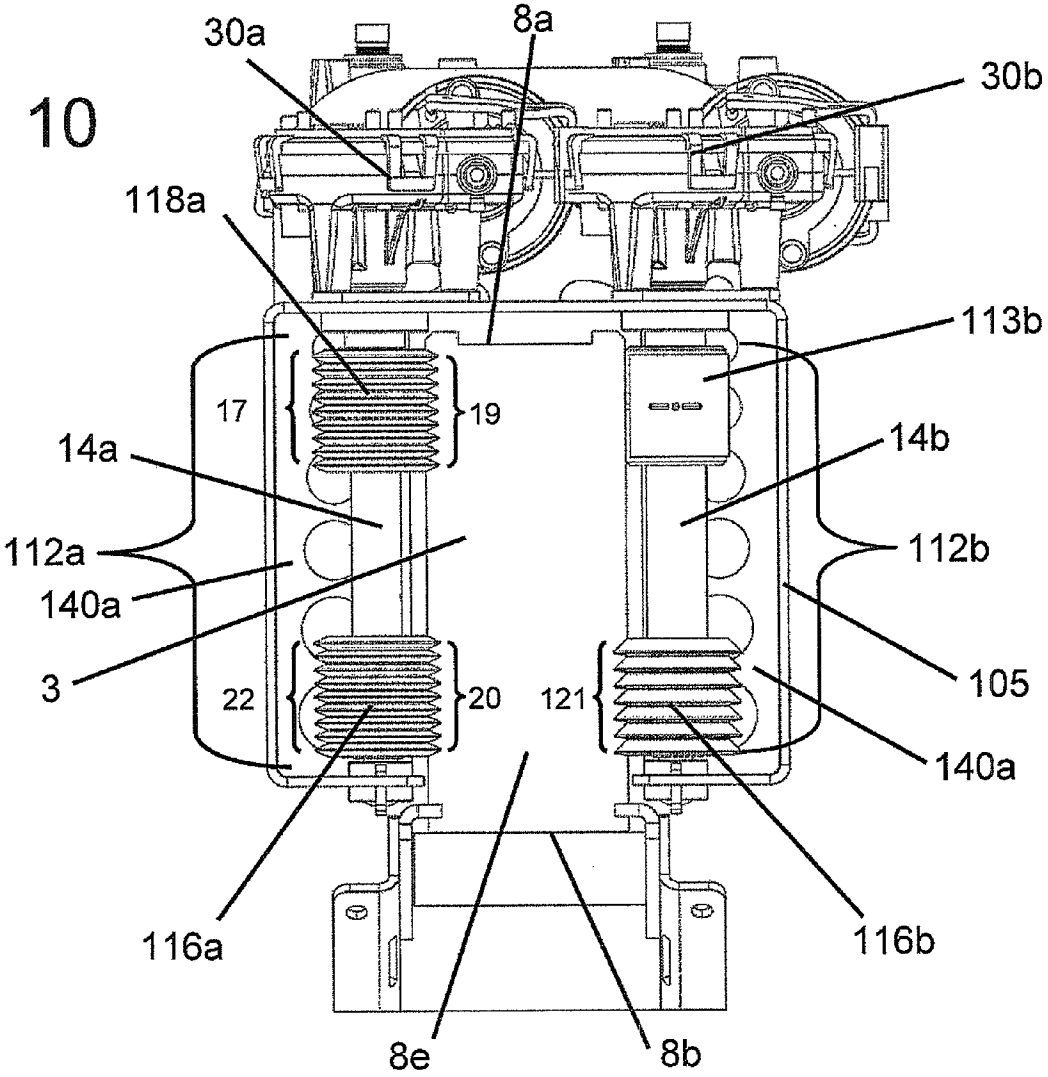
FIG. 10 shows a front view of the second embodiment.

Therefore, the pluralities of roller members 22, 17, 122, 117 of the first roller lower tyre 116*a*, first roller upper tyre 118*a*, fourth roller lower tyre 116*d* and fourth roller upper tyre 118*d* have a virtual line (not shown) between a point and the middle of a respective upper member side surface origin and lower member side surface origin substantially in a plane perpendicular to the respective rotational axis 15*a*, 15*d*. The first roller lower tyre 116*a* and first roller upper tyre with their corresponding pluralities of roller members 22, 17 can be seen in FIG. 10. FIG. 10 shows a side view of the stair lift 101. It is a frontal view with respect to the first end 8*e* and further clearly shows the first roller 112*a* but also the second roller 112*b*.

FIG. 9 provides a good view of the first roller 112*a* and the fourth roller 112*d*. The lower first roller tyre 116*a* and upper first roller tyre 118*a* are arranged as floating tyres with respect to the first roller spindle 14*a*. The lower fourth roller tyre 116*d* and upper fourth roller tyre 118*d* are arranged as floating tyres with respect to the fourth roller spindle 14*d*. This means that the lower first roller tyre 116*a* and the upper first roller tyre 118*a* can move with respect to the first roller spindle 14*a* along the first roller rotational axis 15*a*. Also the lower fourth roller tyre 116*d* and the upper fourth roller tyre 118*d* can move with respect to the fourth roller spindle 14*d* along the fourth roller rotational axis 15*d*. This has as advantage that an optimal friction between the floating tyres and the guide is available for transporting the carriage 5 along the guide 3, even when due to the a-symmetric load the frame 105 at the first side running surface 10*b* is moved upwards. Note, that the lower second roller tyre 116*b* and the lower third roller tyre 116*c* are not floating. These rollers are provided at the opposing second side running surface 10*b* and contribute to the carrying of the carriage 5 by the guide 3. Due to the a-symmetric load the lower second roller tyre 116*b* and the lower third roller tyre 116*c* exert a highest force on the guide 3. Therefore, it is optimal to provide these rollers as fixed along a direction of the respective longitudinal axis.

An amount of movement of the floating tyres can be limitless, meaning that the floating tyres are free to move along the respective rotational axis. Alternatively, the movement of the floating tyres are limited to a certain predetermined amount.

Figure 11:
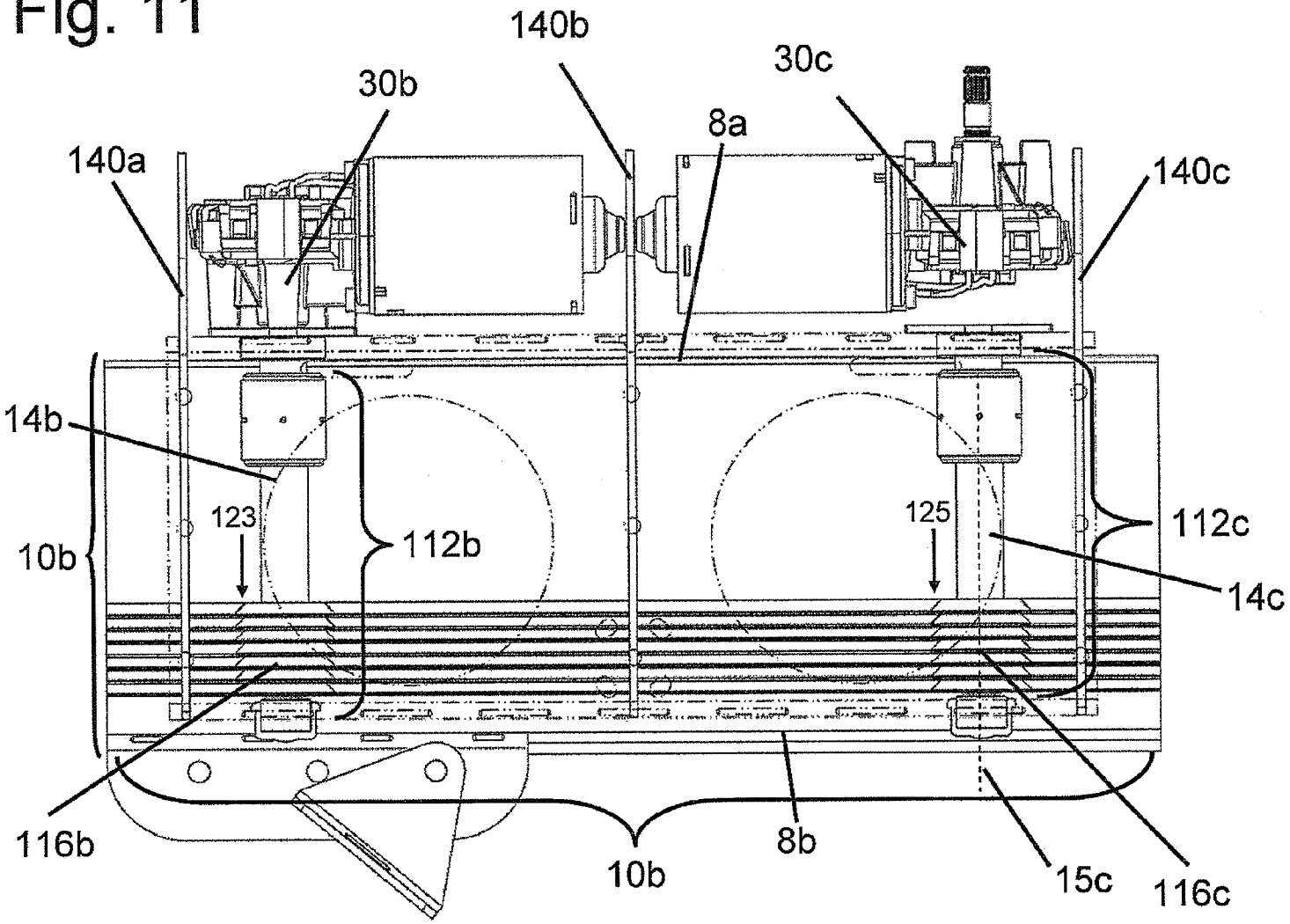
FIG. 11 shows a side view of the second embodiment.

The second embodiment further comprises a pre-stressed frame 105 acting as a passive roller pressing means best seen in FIG. 11. Although, the pre-stressed frame 105, being part of the carriage 5, is described for the second embodiment, the pre-stressed frame 105 is also foreseen to be applied in combination with other embodiment, e.g. the first embodiment. Also, the pre-stressed frame 105, can be applied in other stair lifts driven by friction, e.g. state of art stair lifts. FIG. 11 shows that the frame 105 comprises a front frame rib 140*a*, a middle frame rib 140*b* and an end frame rib 140*c*. The frame ribs 140*a*, 140*b*, 140*c* are substantially fl-shaped (inverse U-shape) having their legs at a lower end of the frame 105. A top of the frame ribs 140*a* is arranged at an upper end of the frame 105. Shown best in FIG. 8 the frame ribs 140*a*, 140*b*, 140*c* are arranged as plates parallel to each other. The frame ribs 140*a*, 140*b*, 140*c* provide structural integrity to the frame 105. The frame 105 is pre-stressed such that the frame 105 presses the rollers towards the guide 3. As shown in FIG. 8, the frame 105 is pre-stressed by means of the frame ribs 140*a*, 140*b*, 140*c*. The legs of each frame rib 140*a*, 140*b*, 140*c* extend towards each other or in other words a distance between leg outer ends of a single frame rib 140*a*, 140*b*, 140*c* is slightly smaller than a distance between leg roots, of the legs of the single frame rib 140*a*, 140*b*, 140*c*. The rollers 112*a*, 112*b*, 112*c*, 112*d* are arranged to the frame 105 with their rotational axes 15*a*, 15*b*, 15*c*, 15*d* substantially parallel to a length of the legs. This results in that particularly the lower rollers 116*a*, 116*b*, 116*c*, 116*d* are pressed towards the side running surfaces 10*a*, 10*b*. This increases friction between the rollers 112*a*, 112*b*, 112*c*, 112*d* and the guide 3. A further advantage is that it may increase safety and redundancy as after wearing of the roller members 22, 17, 122, 117, 123, 125, the rollers 112*a*, 112*b*, 112*c*, 112*d* and thus the roller members 22, 17, 122, 117, 123, 125 are pressed towards the guide 3. A further advantage is that the stair lift 105 may be free from active roller pressure means, for example spring actuated counter rollers. At least the pre-stressed frame 105 is more redundant to wearing of the rollers 112*a*, 112*b*, 112*c*, 112*d*. In a further preference, the difference between the distance between the legs outer ends of the single frame rib 140*a*, 140*b*, 140*c* and the distance between the leg roots of the single frame rib 140*a*, 140*b*, 140*c* is smaller than 3 mm, more particular 2 mm, preferably 1.5 mm.

Preferably, as can be seen in FIG. 7 and FIG. 10, the frame ribs 140*a*, 140*b*, 140*c* comprise multiple circular recesses located in the legs of the frame ribs 140*a*, 140*b*, 140*c* and provide a variable stiffness in the legs of the frame ribs 140*a*, 140*b*, 140*c* depending on a loading of the carriage 5. Stresses in the frame ribs 140*a*, 140*b*, 140*c* resulting from the a-symmetrical load, in particular the first moment of force around an axis parallel to a longitudinal direction of the guide 3, are distributed along the length of the leg. The distributed stresses vary along the length of the leg. More stress occurs near the leg roots and less stress occurs near the leg outer end due to the loading. The circular recess are spaced along the length of the leg and have varying diameters that are representative to the distributed stresses that vary along the length of the leg. In particular, a circular recess located near a leg root has a smaller diameter than a circular recess located near the leg root. A smaller circular recess means more material at that particular location for absorbing the stress. Note that, more material results in more stiffness. A larger circular recess means less material at that particular location for absorbing the stress. Note that, less material results in less stiffness. Therefore, the diameter of each circular recess increases from the leg root towards the leg outer end such that sufficient material is present to absorb the distributed stresses due to the a-symmetrical load. Preferably, 7 circular recesses are arranged in one leg. Advantage is that by having frame ribs 140*a*, 140*b*, 140*c* comprising a stiffness varying arrangement, a more optimal absorption of the stresses by the frame 105 can be acquired. A further advantage is that weight can be saved while sufficient stiffness is provided to the frame 105.

In a further preference, the circular recesses are arranged outwards from a middle of the legs. The middle of a leg is between an inner side of the leg facing the guide 3 and an opposite outer side. Arranged outwards from the middle of the legs meaning arranged closer to the outer side than to the inner side. Near the outer side of the legs, less stiffness is needed as this is the side where the legs are connected with a plate perpendicularly arranged with respect to the frame ribs 140*a*, 140*b*, 140*c* as can be seen in FIG. 8. The fact that the outer side of the legs are connected with the plate, results in more material at that side. This results in that more stiffness is provided near the outer side of the legs, therefore allowing the circular recesses to be larger near the outer side of the legs while still providing sufficient stiffness.

Figure 13A:
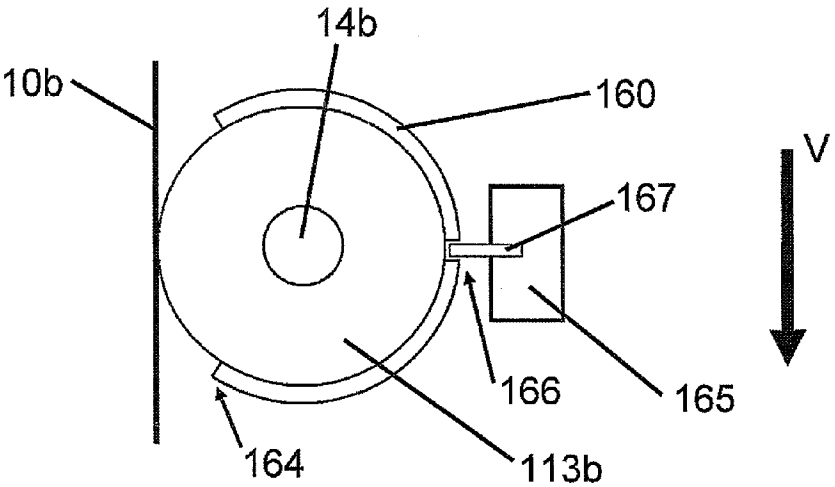
FIG. 13*a* and FIG. 13*b* show a safety mechanism according to the invention.
Figure 13B:
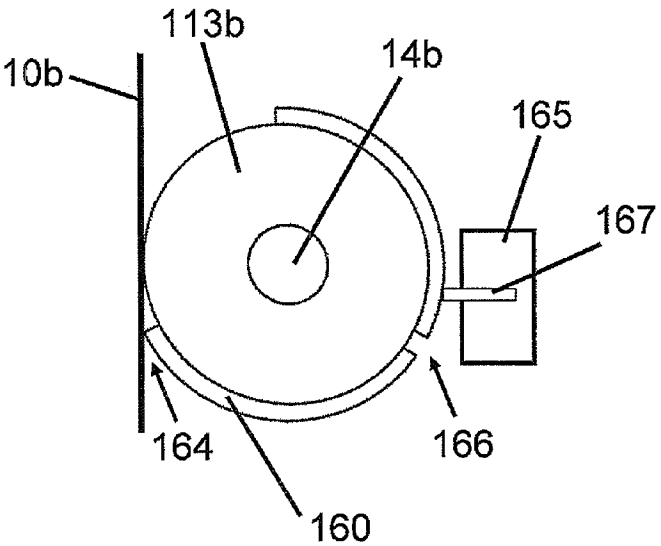

FIG. 13*a* and FIG. 13*b* show a safety mechanism. The safety mechanism is shown for one roller, being the upper auxiliary second roller 113*b*, but may be provided in a similar way to other rollers. The safety mechanism could also be applied in all types of friction drives including state of art friction drives. Advantage of the safety mechanism is that it is easy to control and maintain, simple and cheap. FIG. 13*a* shows the safety mechanism in a free state being a free condition. FIG. 13*b* shows the safety mechanism in a locked state being a locked condition.

In the free state the upper auxiliary second roller 113*b* is in frictional engagement with the guide 3. The upper auxiliary second roller 113*b* is able to rotate along the guide and move in a downward direction seen from FIG. 13*a*. The upper auxiliary second roller 113*b* rotates around the second roller rotational axis 15*b*. An at least partly open sleeve 160 surrounds the upper auxiliary second roller 113*b*. The upper auxiliary second roller 113*b* is able to rotate around the second roller rotational axis 15*b* in the sleeve 160 preferably made from a metal. In other words an outer surface of the upper auxiliary second roller 113*b* moves with respect to an inner surface of the sleeve 160. Although some friction may occur between the upper auxiliary second roller 113*b* and the sleeve this friction is much less than the friction between the upper auxiliary second roller 113*b* and the second side running surface 10*b*. The sleeve 160 comprises a sleeve blocking opening 166. The sleeve blocking opening 166 is able to receive a blocking part 167 which is part of a control unit 165. The control unit 165 is suitable for actuating the blocking part 165. The control unit 165 is fixed to the frame 105 and can actuate the blocking part 167 in the sleeve blocking opening 166. This corresponds with the free state, as shown in FIG. 13*a*. The sleeve is now also fixed with respect to the frame 105.

As the upper auxiliary second roller 113*b* overcomes friction with the sleeve 160 it is able to move downwards or upwards by rotating around the second roller rotational axis 15*b* in a respective direction. This allows the carriage 5 to move upwards and downwards. In FIG. 13*a*, the carriage is moving downwards as indicated with a speed arrow V.

In the locked state, as shown in FIG. 13*b*, the control unit 165 can actuate the blocking part 167 out of the sleeve blocking opening 166. The actuation can for example be by means of a pre-strained spring that is released. The control unit 165 is configured to receive a carriage speed signal which is representative for a carriage speed with respect to the guide 3. Preferably, the safety mechanism comprises a speed measurement sensor configured to measure the carriage speed and provide the carriage speed signal representing the carriage speed to the control unit 165. In a further preference, the speed measurement sensor is an optical sensor arranged to the carriage and measuring a displacement of a side of the guide 3. For example, the optical sensor may be equivalent to a sensor used in an optical computer mouse, the measured surface being a side of the guide 3.

The control unit 165 is furthermore configured to generate a locking command for actuating the upper auxiliary second member 113*b* in the locking state as a function of the carriage speed. When the carriage speed exceeds a predetermined threshold the control unit 165 is configured to generate the locking command. This results in that the blocking part 167 is actuated out of the sleeve blocking opening 166.

When the blocking part 167 is out of the sleeve blocking opening 166, the sleeve 166 is not fixed anymore and the friction between the upper auxiliary second member 113*b* and the sleeve 160 results in the sleeve 160 rotating along with the upper auxiliary second member 113. The sleeve 160 is partly interrupted where the upper auxiliary second member 113*b* faces the second side running surface 10*b*. This interruption creates a lower blocking edge 164 where the sleeve 160 transits in the interruptions. As in the locking state the sleeve 160 rotates with the upper auxiliary second member 113, the lower blocking edge 164 moves with the rotation as well. The lower blocking edge 164 moves until it comes in contact with the second side running surface 10*b*. This results in locking or at least breaking the upper auxiliary second roller 113*b* with respect to the second side running surface 10*b*. The upper auxiliary second roller 113*b* encounters a counter force with respect to a direction of transport. This safety mechanism allows a safety stop when the carriage 5 is transported along the guide 3 with a carriage speed that is higher than the predefined threshold, being a safety speed value.

The stair lift according to the invention is not limited to the described embodiments. Any combination of described embodiments are possible and foreseen.

In an embodiment, the tyres are made from a material having a high friction coefficient such that the tyres can drive the carriage with respect to the guide. Moreover, tyres are made from wear-resistible synthetic material, wherein wear-resistible means longwearing and/or durable. For example the tyres are made from nylon or polyurethane.

Preferably, one or more of the rollers comprise a roller spindle which is made from metal. In an alternative, the roller spindle is made from synthetic material such as plastics.

In an alternative, the roller may be a belt with is driven by at least two drive rollers. This has as advantage that a more efficient stair lift may be possible. The belt is provided with an outer friction surface which is in frictional engagement with a running surface. This surface may extending along the length of the guide which may result in a large contacting surface between the outer friction surface and the running surface. This may result in more friction and a more efficient transport of the carriage.

In an alternative, the guide defines a variable angle with respect to a horizontal plane and/or a vertical plane along the length of the guide. This has as advantage that the stair lift may be used for any shape of staircase.

For example, the staircase may be a spiral staircase, which may result in a variable angle with respect to a vertical plane. In another example, the staircase may have a variable steepness which may result in a variable angle with respect to a horizontal plane. This variable angle is arranged along the length of the staircase.

In another alternative, not all rollers are driven by a drive.

In a further alternative, only one roller is driven by a drive.

In another alternative, the carriage is provided with a third roller, wherein the third roller comprises a third roller peripheral friction surface which is in frictional engagement with the second side running surface for guiding the carriage along the guide and the carriage is further provided with a first drive, a second drive and a third drive that are in a driveable connection with respectively the first roller, the second roller and the third roller such that the carriage is driveable by means of friction between the respective peripheral friction surfaces and the respective side running surfaces.

In a further alternative, the second roller friction surface is provided with a second roller member and the third roller friction surface is provided with a third roller friction surface.

In an alternative further alternative, the carriage comprises a fourth roller, wherein the fourth roller comprises a fourth roller peripheral friction surface which is in frictional engagement with the first side running surface for guiding the carriage along the guide and carriage is further provided with a fourth drive that is in a driveable connection with the fourth roller such that the carriage is driveable by means of friction between the fourth roller peripheral friction surface and the first side running surface.

In a further alternative, the fourth roller friction surface is provided with a fourth roller member.

In another alternative, tyres provided with roller members are rotatably connected with their rotational axis and are therefore not driven by the drive. These tyres may for example run in bearings.

In another alternative, more than one rollers provided with roller members are driven by one drive.

In another alternative, the sleeve 160 is made from a synthetic material, such as nylon or polyurethane.

In another alternative, circular recesses arranged in a frame rib can be any shape. For example rectangular, triangular, elliptical and/or oval.

In another alternative, a number of circular recesses arranged in a leg of a frame can be any number, such as 3, 4, 5, 6, 8, 9, 10.

In another alternative, a roller comprises any number of roller members, such as 1, 2, 3, 4, 5, 8, 10, 15, 20.

In another alternative, a side running surface comprises any number of side running surface members, such as 1, 2, 3, 4, 5, 8, 10, 15, 20, 40, 60.

In another alternative, a side running surface is arranged with side running surface members which are spaced from a topside to a downside.

In another embodiment, a roller comprises any number of roller members and a side running surface comprises any number of side running surface members, wherein the number of roller members is equal or less than the number of side running surface members.

In another alternative, a shape of roller members at an outer end may be any shape such as U-shaped or V-shaped or composed of multiple member side surfaces arranged at an angle with respect to an auxiliary plane perpendicular to a respective roller rotational axis.

In a further alternative, the shape of the roller members varies along its outer end and may for example be an undulated surface.

The invention claimed is:

1. A stair lift for transporting a load, comprising:

a longitudinal guide comprising a longitudinal length having a first end and a second opposed end defining a longitudinal axis therein between and further comprising opposed first and second side surfaces, the first opposed side surface comprising a first side running surface and the second opposed side surface comprising a second side running surface; and a carriage which is transportable along the guide comprising:

a first roller comprising a first roller peripheral friction surface which is in frictional engagement with the first side running surface for guiding the carriage along the guide; and a second roller comprising a second roller peripheral friction surface which is in frictional engagement with the second side running surface for guiding the carriage along the guide, wherein the first roller peripheral friction surface of the first roller comprises a plurality of first roller members that peripherally extend in a plane perpendicular to a rotational axis of the first roller and the first side running surface of the first opposed side surface of the guide comprises a plurality of longitudinal first side running surface members that longitudinally extend along the longitudinal axis of the longitudinal guide and that fit complementary and make contact with the plurality of the first roller members for supporting the plurality of the first roller members of the first roller on the plurality of the longitudinal first side running surface members of the first side running surface to carry at least part of the weight of the load, wherein, each of the first roller members is a first roller flange and each of the first side running surface members is a first side running surface recess which receives one of the first roller flanges, or each of the first roller members is a first roller groove and each of the first side running surface members is a first side running surface ridge which is received by one of the first roller grooves, wherein each of the first roller members comprises an upper member side surface and a lower member side surface, which both are in contact with one of the first side running surface members, and wherein the carriage comprises a first drive that is in a driveable connection with the first roller to rotate the first roller about the rotational axis of the first roller to drive the first roller along the first side running surface of the longitudinal guide such that the carriage is transportable along the guide by means of friction between the plurality of the first roller members of the first roller peripheral friction surface and the plurality of the longitudinal first side running surface members of the first side running surface.

2. A stair lift for transporting a load, comprising:

a longitudinal guide comprising a longitudinal length having a first end and a second opposed end defining a longitudinal axis therein between and further comprising opposed first and second side surfaces, the first opposed side surface comprising a first side running surface and the second opposed side surface comprising a second side running surface; and a carriage which is transportable along the guide comprising:

a first roller comprising a first roller peripheral friction surface which is in frictional engagement with the first side running surface for guiding the carriage along the guide; and a second roller comprising a second roller peripheral friction surface which is in frictional engagement with the second side running surface for guiding the carriage along the guide, wherein the first roller peripheral friction surface of the first roller comprises a plurality of first roller members that peripherally extend in a plane perpendicular to a rotational axis of the first roller and the first side running surface of the first opposed side surface of the guide comprises a plurality of longitudinal first side running surface members that longitudinally extend along the longitudinal axis of the longitudinal guide and that fit complementary and make contact with the plurality of the first roller members for supporting the plurality of the first roller members of the first roller on the plurality of the longitudinal first side running surface members of the first side running surface to carry at least part of the weight of the load, wherein each of the first roller members comprises an upper member side surface and a lower member side surface, which both are in contact with one of the first side running surface members, and wherein the carriage comprises a first drive that is in a driveable connection with the first roller to rotate the first roller about the rotational axis of the first roller to drive the first roller along the first side running surface of the longitudinal guide such that the carriage is transportable along the guide by means of friction between the plurality of the first roller members of the first roller peripheral friction surface and the plurality of the longitudinal first side running surface members of the first side running surface.

3. The stair lift according to claim 2, wherein the stair lift further comprises a load carrier, wherein a centre of gravity of the load carrier lies outwards from the second side running surface and thus at a distance from the guide and away from the first side running surface when seen in a direction perpendicular to the second side surface, and wherein the first roller member and the complementary first side running surface member are arranged higher than the second roller and the second side running surface.

4. The stair lift according to claim 2, wherein the second roller friction surface is provided with a second roller member which peripherally extends in a plane perpendicular to a rotational axis of the second roller and the second side running surface of the guide is provided with a longitudinal second side running surface member which fits complementary with the second roller member for supporting the second roller member of the second roller on the second side running surface member of the second side running surface to carry at least part of the weight of the load.

5. The stair lift according to claim 4, wherein the plurality of longitudinal first side running surface members comprise at least three first side running surface members;

wherein the longitudinal second side running surface member comprises at least three second side running surface members;

wherein the first roller comprises at least three first roller members; and wherein the second roller comprises at least three second roller members.

6. The stair lift according to claim 2, wherein the carriage is provided with a second drive that is in a driveable connection with the second roller such that the carriage is transportable along the rail by means of friction between the second roller member of the second roller and the second roller member of the second side running surface.

7. The stair lift according to claim 2, wherein the carriage is provided with a third roller, wherein the third roller comprises a third roller peripheral friction surface which is in frictional engagement with the second side running surface for guiding the carriage along the guide.

8. The stair lift according to claim 7, wherein the first roller is arranged between the second roller and the third roller, when seen in a direction along the guide.

9. The stair lift according to claim 7, wherein the carriage is provided with a fourth roller, and wherein the fourth roller comprises a fourth roller peripheral friction surface which is in frictional engagement with the first side running surface for guiding the carriage along the guide.

10. The stair lift according to claim 7, wherein the stair lift further comprises a load carrier, wherein a centre of gravity of the load carrier lies outwards from the second side running surface and thus at a distance from the guide and away from the first side running surface when seen in a direction perpendicular to the second side surface and wherein the first roller is arranged opposite to the third roller or the second roller.

11. The stair lift according to claim 2, wherein the carriage is free from active pressure means configured to increase the friction between the first roller and the first side running surface via a spring.

12. The stair lift according to claim 2, wherein the first roller member is a first roller flange and the first side running surface member is a first side running surface recess which receives the first roller flange.

13. The stair lift according to claim 12, wherein the first roller flange has a point shape outer end and the first side running surface recess has a complementary V-shape inner end.

14. The stair lift according to claim 2, wherein the first roller member is a first roller groove and the first side running surface member is a first side running surface ridge which is received by the first roller groove.

15. The stair lift according to claim 14, wherein the first roller groove has a point shape inner end and the first side running surface ridge has a complementary V-shape outer end.

16. The stair lift according to claim 2, wherein the first roller member comprises an upper member side surface and a lower member side surface, and wherein an upper member side surface angle defined between the upper member side surface and an auxiliary plane perpendicular to the rotational axis of the first roller is larger than a lower member side surface angle defined between the lower member side surface and the auxiliary plane.

17. The stair lift according to claim 2, wherein the guide comprises a topside and a downside and the carriage is free from rollers engaging on the topside and the downside.

18. The stair lift according to claim 2, wherein the guide is an aluminium extruded rail.

19. The stair lift according to claim 2, wherein the plurality of longitudinal first side running surface members comprise at least three first side running surface members; and wherein the plurality of first roller members comprises at least three first roller members.

20. A method for transporting a load over a staircase by means of a stair lift, comprising:

providing the stair lift according claim 2; and transporting the carriage along the guide from a start point to an end point.

* * * * *